US011657769B1

(12) United States Patent
Jang et al.

(10) Patent No.: US 11,657,769 B1
(45) Date of Patent: May 23, 2023

(54) ELECTROLUMINESCENT DISPLAY DEVICE AND METHOD OF COMPENSATING FOR LUMINANCE IN THE SAME

(71) Applicant: Samsung Electronics Co., Ltd., Suwon-si (KR)

(72) Inventors: Byoungyoon Jang, Gimhae-si (KR); Sewhan Na, Suwon-si (KR); Jonghee Na, Hwaseong-si (KR); Yonghoon Yu, Suwon-si (KR); Hyunwook Lim, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 17/895,544

(22) Filed: Aug. 25, 2022

(30) Foreign Application Priority Data

Nov. 18, 2021 (KR) ..... 10-2021-0159003
Feb. 9, 2022 (KR) ..... 10-2022-0016880

(51) Int. Cl.
*G09G 3/3291* (2016.01)
*G09G 3/20* (2006.01)

(52) U.S. Cl.
CPC ..... *G09G 3/3291* (2013.01); *G09G 3/2003* (2013.01); *G09G 2320/0233* (2013.01); (Continued)

(58) Field of Classification Search
CPC .. G09G 3/3648; G09G 3/3611; G09G 3/3655; G09G 3/344; G09G 3/3607; G09G 3/3677; G09G 3/3233; G09G 3/3266; G09G 2300/0426; G09G 2300/08; G09G 2300/0861; G09G 2300/0452; G09G 2300/0439; G09G 2320/045; G09G 2320/0233; G09G 2310/0267
See application file for complete search history.

(56) References Cited

U.S. PATENT DOCUMENTS 7,023,451 B2 4/2006 Feng
7,745,779 B2 6/2010 Conners
(Continued)

FOREIGN PATENT DOCUMENTS

KR 10-2019-0073637 A 6/2019
KR 10-2020-0088935 A 7/2020
KR 10-2020-0105593 A 9/2020

*Primary Examiner* — Dong Hui Liang
(74) *Attorney, Agent, or Firm* — Harness, Dickey & Pierce, P.L.C.

(57) ABSTRACT

An electroluminescent display device includes a display panel including pixels, a storage circuit, a luminance compensation circuit and a data driver. The storage circuit stores information on a leakage curve indicating a luminance change value of a target pixel according to a change of an input pixel value of a neighboring pixel, the plurality of pixels including the target pixel and the neighboring pixel. The luminance compensation circuit receives input pixel values corresponding to the pixels and generates compensated pixel values respectively corresponding to the pixels by compensating for lateral leakage based on the leakage curve, where the lateral leakage is caused by leakage currents through a common conduction layer of the pixels. The data driver drives the pixels based on the compensated pixel values. The exact (or close) luminance of the input image is realized by compensating for the luminance distortion.

20 Claims, 26 Drawing Sheets

(52) U.S. Cl.
CPC ..... *G09G 2320/0242* (2013.01); *G09G 2320/0276* (2013.01); *G09G 2320/0285* (2013.01); *G09G 2320/0673* (2013.01); *G09G 2360/16* (2013.01)

(56) References Cited

U.S. PATENT DOCUMENTS

| | | | | |
|---|---|---|---|---|
| 8,587,621 | B2 | 11/2013 | Malka et al. | |
| 9,111,485 | B2 | 8/2015 | Chaji et al. | |
| 10,535,293 | B2 | 1/2020 | Hwang et al. | |
| 2019/0067392 | A1* | 2/2019 | Baik | H01L 27/3209 |
| 2020/0219432 | A1* | 7/2020 | Park | G09G 3/2003 |
| 2020/0226969 | A1 | 7/2020 | Jun et al. | |
| 2020/0279518 | A1 | 9/2020 | Pyo et al. | |
| 2022/0139298 | A1* | 5/2022 | Park | G09G 3/2003 345/76 |

* cited by examiner

LUTrg

| GSV | g1 | g2 | ··· | gs |
|---|---|---|---|---|
| ΔLV | l1 | l2 | ··· | ls |

FIG. 20

LUTg

| | | GSV | | | | |
|---|---|---|---|---|---|---|
| | | g1 | g2 | g3 | ··· | gm |
| LVC | -Ig | cg1 | cg2 | cg3 | ··· | cg4 |
| | ⋮ | ⋮ | ⋮ | ⋮ | ··· | ⋮ |
| | -I2 | cg5 | cg6 | cg7 | ··· | cg8 |
| | -I1 | cg9 | cg10 | cg11 | ··· | cg12 |
| | I1 | cg13 | cg14 | cg15 | ··· | cg16 |
| | I2 | cg17 | cg18 | cg19 | ··· | cg20 |
| | ⋮ | ⋮ | ⋮ | ⋮ | ··· | ⋮ |
| | Ip | cg21 | cg22 | cg23 | ··· | cg24 |

ELECTROLUMINESCENT DISPLAY DEVICE AND METHOD OF COMPENSATING FOR LUMINANCE IN THE SAME

CROSS-REFERENCE TO RELATED APPLICATIONS

This U.S. non-provisional application claims priority under 35 USC § 119 to Korean Patent Application No. 10-2021-0159003 filed on Nov. 18, 2021 in the Korean Intellectual Property Office (KIPO) and Korean Patent Application No. 10-2022-0016880 filed on Feb. 9, 2022, in the KIPO, the disclosures of which are incorporated by reference herein in their entirety.

BACKGROUND

1. Technical Field

Example embodiments relate generally to semiconductor integrated circuits, and more particularly to an electroluminescent display device and method of compensating for luminance in the electroluminescent display device.

2. Discussion of the Related Art

The development of information technologies has caused the importance of display devices as a connection medium between a user and information to increase. Accordingly, display devices (such as liquid crystal display devices, plasma display devices, electroluminescent display devices) are widely used. Electroluminescent display devices can be driven with quick response speeds and low power consumption using a matrix of light-emitting diodes (LEDs) or organic light-emitting diodes (OLEDs) that emit light through recombination of electrons and holes.

In general, the OLED display device may provide respective driving currents corresponding to image data to respective OLEDs using driving transistors respectively included in pixels. The driving current flowing through each pixel may leak into neighboring pixels through common conduction layers such as a hole injection layer and so on. As a result, the pixel may not emit the light of proper luminance. This phenomenon may be referred to as a lateral leakage.

SUMMARY

Some example embodiments may provide electroluminescent display devices and associated methods, capable of efficiently compensating for luminance distortion due to lateral leakage.

According to example embodiments, an electroluminescent display device includes a display panel including a plurality of pixels, a storage circuit, a luminance compensation circuit and a data driver. The storage circuit stores information on a leakage curve indicating a luminance change value of a target pixel according to a change of an input pixel value of a neighboring pixel, the plurality of pixels including the target pixel and the neighboring pixel. The luminance compensation circuit receives a plurality of input pixel values corresponding to the plurality of pixels and generates a plurality of compensated pixel values respectively corresponding to the plurality of pixels by compensating for lateral leakage based on the leakage curve, where the lateral leakage is caused by leakage currents through a common conduction layer of the plurality of pixels. The data driver drives the plurality of pixels based on the plurality of compensated pixel values, respectively.

According to example embodiments, a method of compensating for luminance in an electroluminescent display device, includes, generating information on a leakage curve indicating a luminance change value of a target pixel according to a change of an input pixel value of a neighboring pixel, receiving a plurality of input pixel values corresponding to a plurality of pixels included in a display panel, the plurality of pixels including the target pixel and the neighboring pixel, generating a plurality of compensated pixel values respectively corresponding to the plurality of pixels by compensating for lateral leakage based on the leakage curve, the lateral leakage being caused by leakage currents through a common conduction layer of the plurality of pixels, and driving the plurality of pixels based on the plurality of compensated pixel values.

According to example embodiments, a method of compensating for luminance in an electroluminescent display device, includes, setting a compensation window, the compensation window including a target pixel and a plurality of neighboring pixels, generating a leakage luminance change value based on input pixel values of the plurality of neighboring pixels and a leakage curve indicating a luminance change value of the target pixel according to a change of an input pixel value of a neighboring pixel, generate a target luminance change value based on an input pixel value of the target pixel and the leakage curve, generating a compensation luminance change value, the compensation luminance change value corresponding to a difference between the leakage luminance change value and the target luminance change value, generating a compensated pixel value of the target pixel based on the input pixel value of the target pixel and the compensation luminance change value, and driving the target pixel based on the compensated pixel value of the target pixel.

The electroluminescent display device and the method of compensating for luminance in the electronic device may realize the exact or closer luminance of the input image by compensating for the luminance distortion due to the lateral leakage based on the leakage curve and the input pixel values.

In addition, the luminance of the input image may be realized exactly (or closely) regardless of the disposition and the emission distribution of the pixels by compensating for the luminance distortion pixel by pixel. Through the compensation of the lateral leakage, the quality of the displayed image may be improved and the performance of the electroluminescent display device may be enhanced.

BRIEF DESCRIPTION OF THE DRAWINGS

Example embodiments of the present disclosure will be more clearly understood from the following detailed description taken in conjunction with the accompanying drawings.

FIGS. 19 and 20 are diagrams illustrating an example embodiment of gamma curve information in a method of compensating for luminance in an electroluminescent display device according to some example embodiments.

DETAILED DESCRIPTION OF THE EXAMPLE EMBODIMENTS

Figure 1:
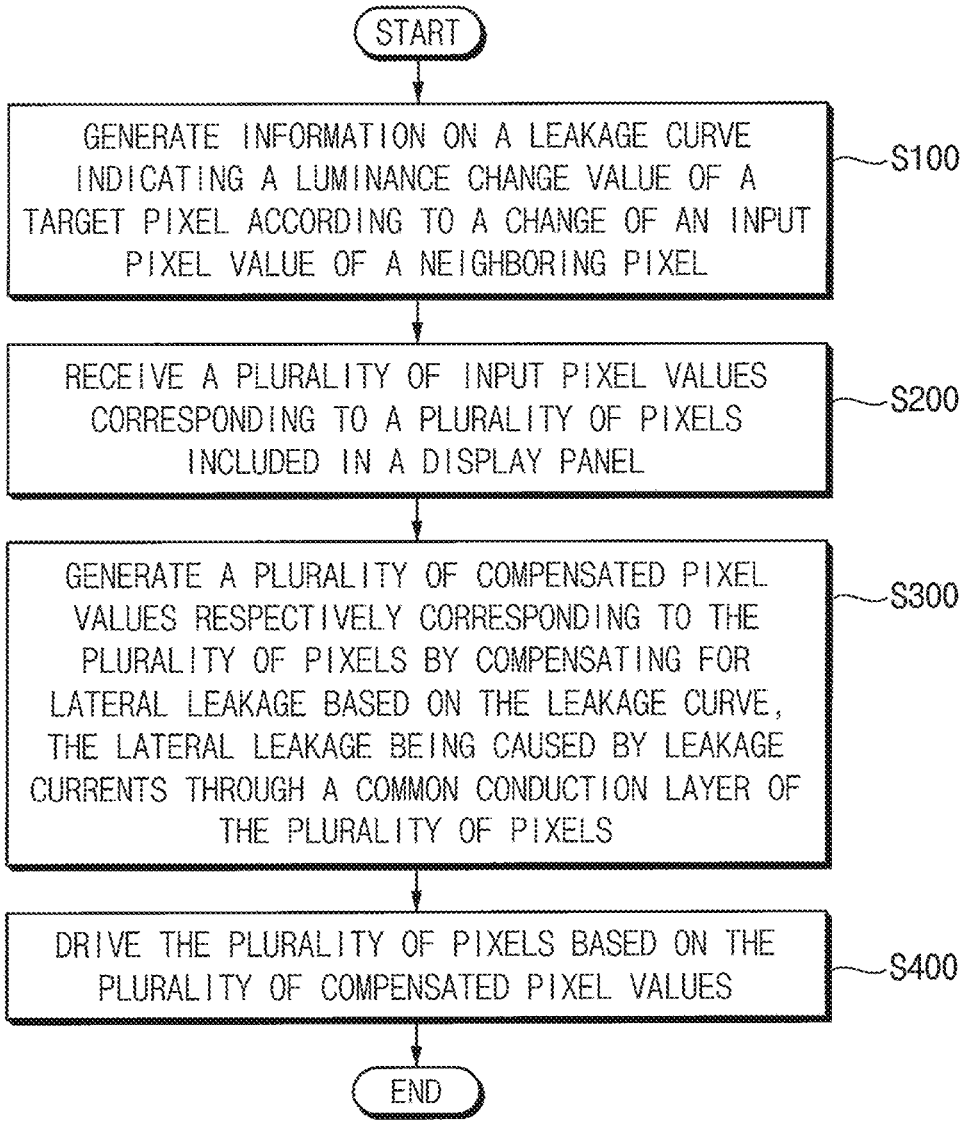
FIG. 1 is a flowchart illustrating a method of compensating for luminance in an electroluminescent display device according to some example embodiments.

Various example embodiments will be described more fully hereinafter with reference to the accompanying drawings, in which some example embodiments are shown. In the drawings, like numerals refer to like elements throughout. The repeated descriptions may be omitted.

FIG. 1 is a flowchart illustrating a method of compensating for luminance in an electroluminescent display device according to some example embodiments.

Referring to FIG. 1, information on a leakage curve indicating a luminance change value of a target pixel according to a change of an input pixel value of a neighboring pixel may be generated (S100). The leakage curve may represent characteristics due to lateral leakage of a display panel. In some example embodiments, the characteristics due to lateral leakage may be changed depending on a color corresponding to a pixel. In this case, as will be described below with reference to FIGS. 12 and 13, the leakage curve may include a plurality of color leakage curves respectively corresponding to different combinations of a target color of the target pixel and a neighboring color of the neighboring pixel. The information on the leakage curve may be provided as a plurality of lookup tables respectively corresponding to the plurality color leakage curves.

A plurality of input pixel values corresponding to a plurality of pixels included in a display panel may be received (S200), for example, by a luminance compensation circuit as described with reference to FIG. 7. The plurality of input pixel values may correspond to one frame data.

A plurality of compensated pixel values respectively corresponding to the plurality of pixels may be generated by compensating for lateral leakage based on the leakage curve, where the lateral leakage is caused by leakage currents through a common conduction layer of the plurality of pixels (S300). The lateral leakage due to the leakage currents will be described with reference to FIGS. 2 and 3.

Each of (or alternatively, at least one of) the plurality of pixels may be determined as the target pixel, and the compensated pixel value corresponding to the target pixel may be generated based on the input pixel values of the target pixel and neighboring pixels adjacent to the target pixel. As such, the plurality of compensated pixel values respectively corresponding to the plurality of pixels may be generated pixel by pixel.

The plurality of pixels may be driven based on the plurality of compensated pixel values (S400). The driving of a pixel based on a pixel value will be described with reference to FIGS. 5 and 6.

As such, the luminance of an input image represented by the plurality of input pixel values may be realized exactly or closely by compensating for the luminance distortion due to the lateral leakage based on the lateral leakage and the input pixel values.

Figure 2:
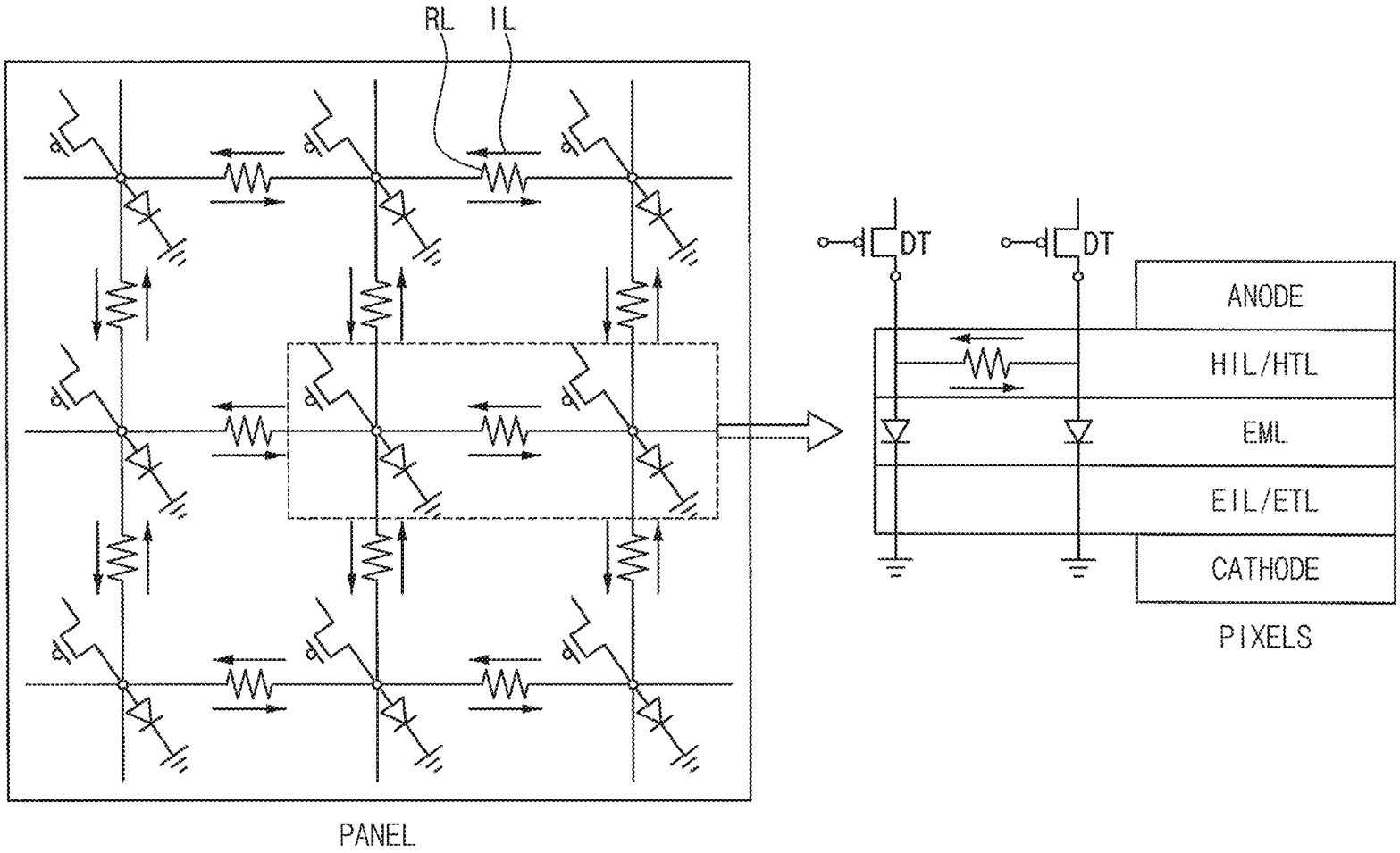
FIG. 2 is a diagram for describing a lateral leakage in an electroluminescent display device according to some example embodiments.

FIG. 2 is a diagram for describing a lateral leakage in an electroluminescent display device according to some example embodiments.

An example layout of a display panel is illustrated in the left portion of FIG. 2, and a vertical structure corresponding to two adjacent pixels is illustrated in a right portion of FIG. 2.

Referring to FIG. 2, an organic light emitting diode (OLED) display may include a plurality of organic layers disposed between an anode and a cathode. For example, the plurality of organic layers may include an emission layer EML, a hole injection layer HIL, a hole transport layer HTL, an electron injection layer EIL, an electron transport layer ETL, and so on.

A portion of the organic layers may have a structure of a common conduction layer that is shared by a plurality of pixels. For example, the hole injection layer HIL and the hole transport layer HTL may be manufactured as the common conduction layer. In this case a conduction path may be formed between the pixels and a crosstalk problem may occur that that a current flowing through each driving transistor DT of each pixel leaks into adjacent pixels through the conduction path having a finite resistance. Accordingly, the luminance of the target pixel may be distorted depending on the leakage currents depending on the input pixel values of the neighboring pixels.

The lateral leakage occurring at the target pixel may be extracted according to the disposition and the emission distribution of the neighboring pixels and apply the compensated pixel value of the target pixel based on the lateral leakage. As a result, the exact (or a close) luminance corresponding to the input pixel value of the target pixel may be realized regardless of the disposition and the emission distribution of the neighboring pixels.

Figure 3:
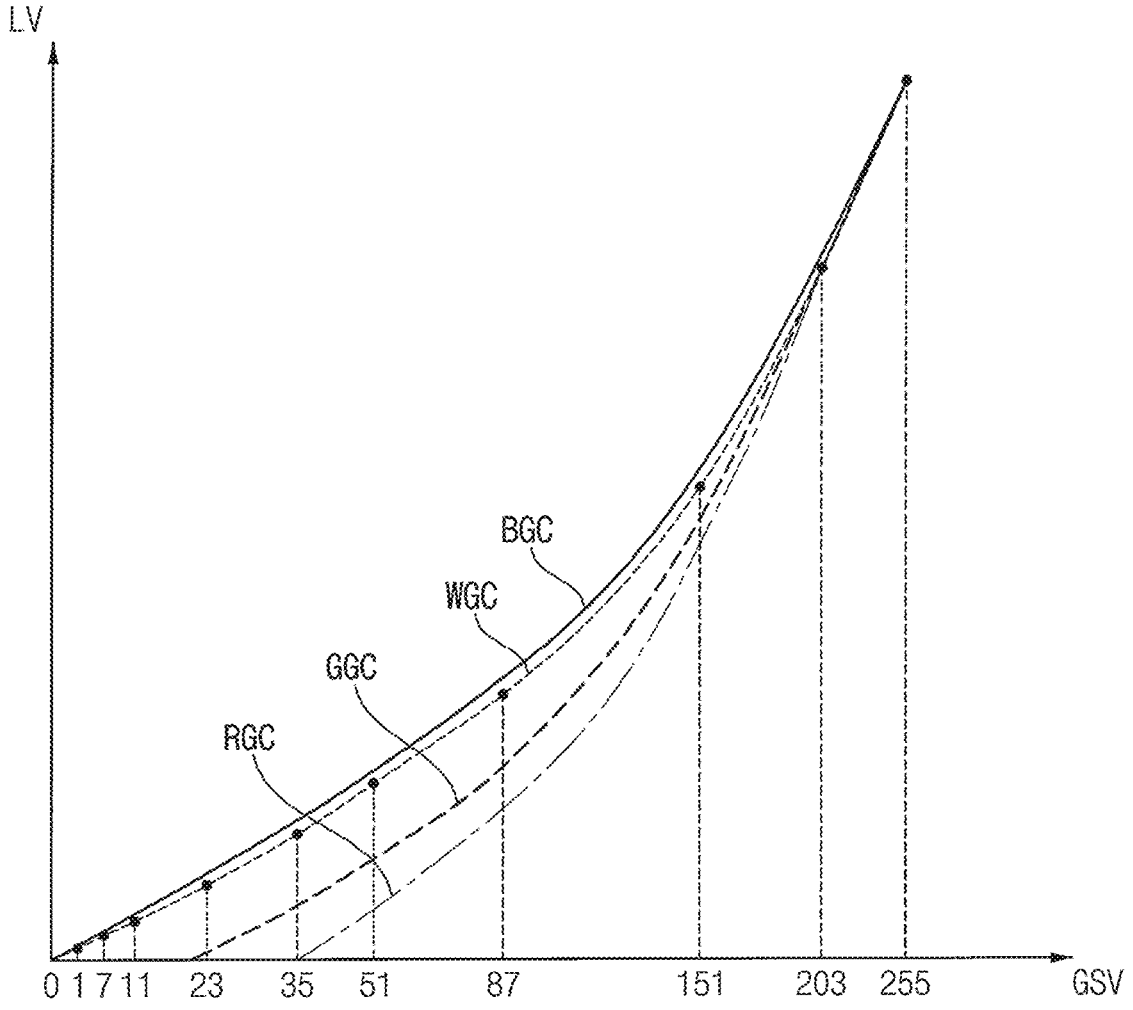
FIG. 3 is a diagram illustrating gamma characteristics of an electroluminescent display device according to some example embodiments.

FIG. 3 is a diagram illustrating gamma characteristics of an electroluminescent display device according to some example embodiments.

In FIG. 3, the horizontal axis indicates grayscale value GSV and the vertical axis indicates luminance value LV. FIG. 3 illustrates an example that an input pixel value is 8-bit data and the input pixel value may be one of 256 grayscale values from the minimum grayscale value of 0 corresponding to darkest luminance to the maximum grayscale value of 255 corresponding to brightest luminance.

Referring to FIG. 3, when single color light instead of the white color light is emitted using the set grayscale voltages, the luminance of the single color light does not accurately correspond to a desired gamma curve. The gamma curve may correspond to a white color light curve WGC. In addition, low grayscale expression is uncertain since luminance differences between low grayscales are insufficient.

The gamma curve may generally follow the following Expression 1.

$$y=ax^{GM}+b \qquad \text{Expression 1}$$

In Expression 1, x may be a grayscale value, y may be a luminance value, a and b may be arbitrary constants, and GM may be a gamma value. For convenience of description, the constants a and b are neglected, shapes of curves are described using the gamma value GM. When the gamma value GM corresponds to 1, the gamma curve corresponds to a straight line instead of a curve, and the gamma curve becomes convex adjacent to the x axis as the gamma value GM is greater than 1.

As illustrated in FIG. 3, a gamma value of a first single color light curve RGC may be greater than that of the white color light curve WGC. In addition, a gamma value of a second single color light curve GGC may be greater than that of the white color light curve WGC and be smaller than that of the first single color light curve RGC. In addition, a gamma value of a third single color light curve BGC may be smaller than that of the white color light curve WGC. For example, a first color may be the red color, a second color may be the green color, and a third color may be the blue color.

Therefore, although the same input grayscale value is expressed when single color light is emitted and when the white color light is emitted, the single color light curves RGC, GGC and BGC may be different from each other because of the lateral leakage.

According to some example embodiments, the gamma value of the first single color light curve RGC may be decreased by correcting the input pixel value, so that the first single color light curve RGC may be adjusted to become similar to the white color light curve WGC. In addition, the gamma value of the second single color light curve GGC may be decreased by correcting the input pixel value, so that the second single color light curve GGC may be adjusted to become similar to the white color light curve WGC. A decrement in the gamma value of the second single color curve GGC may be smaller than that in the gamma value of the first single color light curve RGC. Similarly, the gamma value of the third single color light curve BGC may be decreased by correcting the input grayscale value, so that the third single color light curve BGC can be adjusted to become similar to the white color light curve WGC.

As such, the luminance of the single color lights may be exactly (or closely) represented according to the targeted gamma curve. In addition, low grayscale expression can be further clarified. Example embodiments may be equally applied to the cases of double mixed color light and triple mixed color light. Thus, the input grayscale value is corrected, so that the double mixed color light curve may be adjusted to become similar to the white color light curve WGC. In addition, the input grayscale value is corrected, so that the triple mixed color light curve can be adjusted to become similar to the white color light curve WGC.

Figure 4:
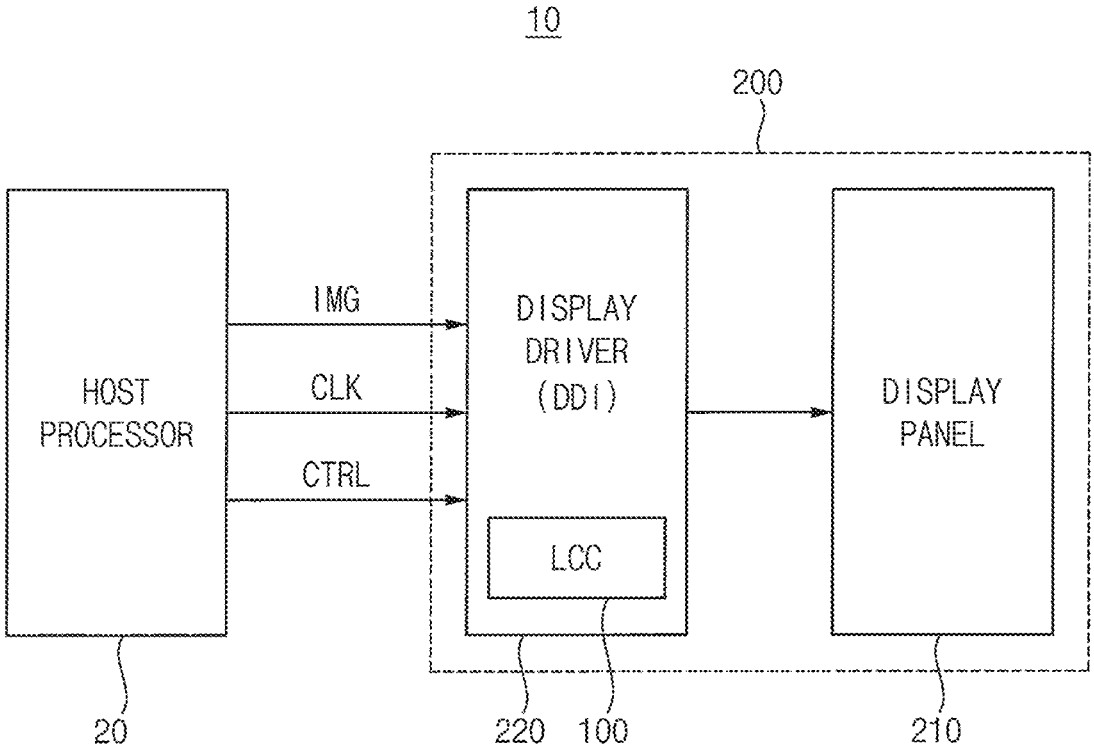
FIG. 4 is a block diagram illustrating a display system according to some example embodiments.

FIG. 4 is a block diagram illustrating a display system according to some example embodiments.

A display system 10 may be various electronic devices having a function of image display such as a mobile phone, a smartphone, a tablet personal computer (PC), a personal digital assistant (PDA), a wearable device, a potable multimedia player (PMP), a handheld device, a handheld computer, and so on.

Referring to FIG. 4, the display system 10 may include a host processor 20 and a display device 200.

The host processor 20 may control overall operations of the display system 10. The host processor 10 may be an application processor (AP), a baseband processor (BBP), a micro-processing unit (MPU), and so on. The host processor 20 may provide input image data IMG, a clock signal CLK and control signals CTRL to the display device 200. For example, the input image data IMG may include RGB pixel values and have a resolution of w*h where w is a number of pixels in a horizontal direction and h is a number of pixels in a vertical direction.

The control signals may include a command signal, a horizontal synchronization signal, a vertical synchronization signal, a data enable signal, and so on. For example, the input image data IMG and the control signals CTRL may be provided, as a form of a packet, to a display driver (DDI) 220 in the display device 200. The command signal may include control information, image information and/or display setting information. The control information may be used to control the display driver 220 to adjust the input image data IMG. The image information may include, for example, a resolution of the input image data IMG. The display setting information may include, for example, panel information, a luminance setting value, and so on. For example, the host processor 20 may provide, as the display setting information, information according to a user input or according to predetermined (or alternatively, desired) setting values.

The display driver 220 may drive the display panel 210 based on the input image data IMG and the control signals CTRL. The display driver 220 may convert the digital input image signal IMG to analog signals, and drive the display panel 210 based on the analog signals.

The display driver 220 includes a luminance compensation circuit LCC 100. The luminance compensation circuit 100 may compensate pixel values of the input image data IMG so that the display driver 220 may drive the display panel 210 based on the compensated pixel values. As will be described below, the luminance compensation circuit 100 may be implemented to perform the method of compensating for luminance in an electroluminescent display device according to some example embodiments.

Figure 5:
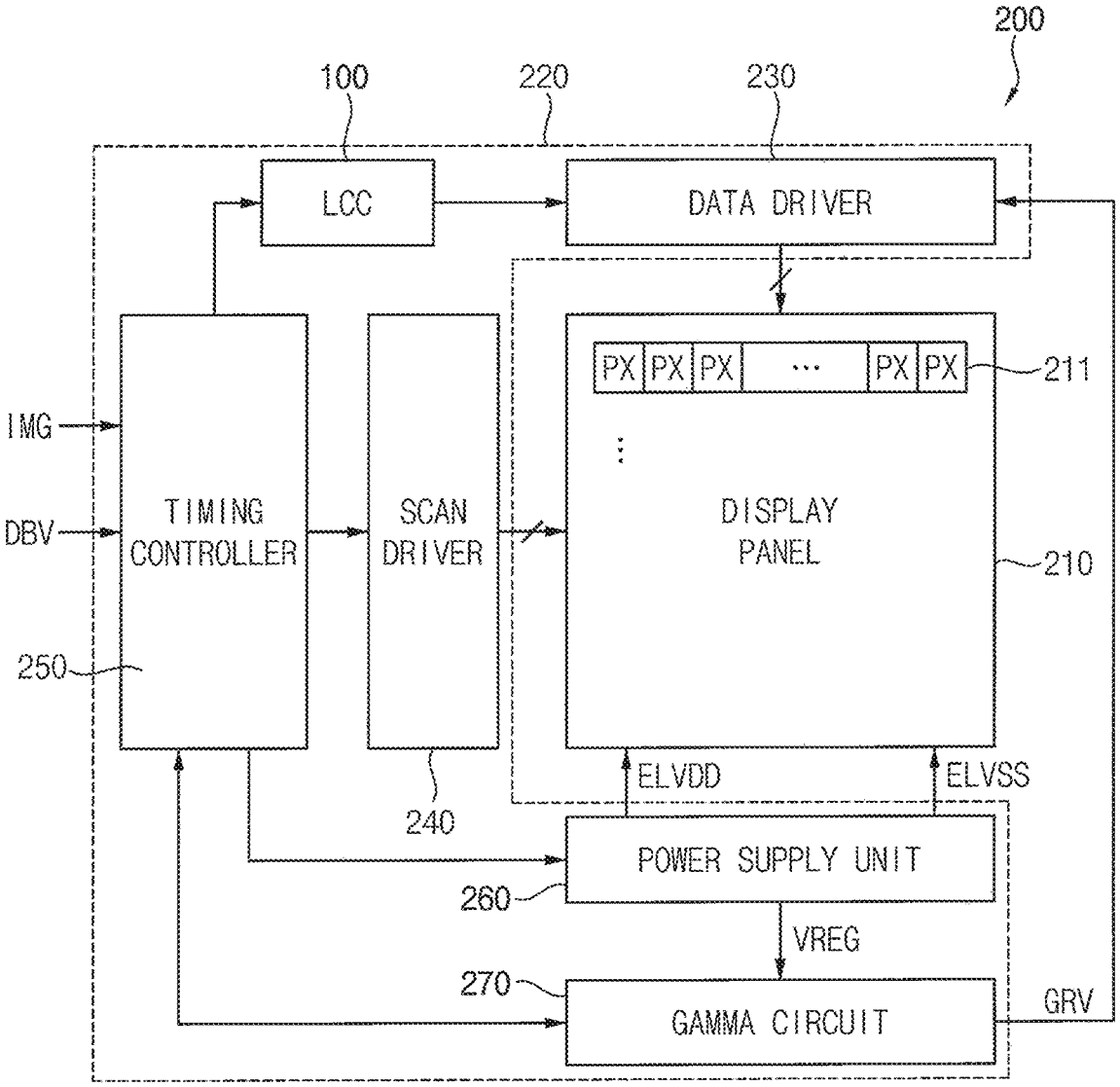
FIG. 5 is a block diagram illustrating an electroluminescent display device according to some example embodiments.

FIG. 5 is a block diagram illustrating an electroluminescent display device according to some example embodiments.

Referring to FIG. 5, an electroluminescent display device 200 may include a display panel 210 including a plurality of pixel rows 211 and a display driver 220 that drives the display panel 210. The display driver 220 may include a data driver 230, a scan driver 240, a timing controller 250, a power supply 260, a luminance compensation circuit 100 and a gamma circuit 270.

The display panel 210 may be connected to the data driver 230 of the display driver 220 through a plurality of data lines and may be connected to the scan driver 240 of the display driver 220 through a plurality of scan lines. The display panel 210 may include the pixel rows 211. That is, the display panel 210 may include a plurality of pixels PX arranged in a matrix having a plurality of rows and a plurality of columns. One row of pixels PX connected to the same scan line may be referred to as one pixel row 211. In some example embodiments, the display panel 210 may be a self-emitting display panel that emits light without the use of a back light unit. For example, the display panel 210 may be an organic light-emitting diode (OLED) display panel.

Each pixel PX included in the display panel 210 may have various configurations according to a driving scheme of the display device 200. For example, the electroluminescent display device 200 may be driven with an analog or a digital driving method. While the analog driving method produces grayscale using variable voltage levels corresponding to input data, the digital driving method produces grayscale using variable time duration in which the LED emits light. The analog driving method is difficult to implement because the analog driving method uses a driving integrated circuit (IC) that is complicated to manufacture if the display is large and has high resolution. The digital driving method, on the other hand, may readily accomplish high resolution through a simpler IC structure. As the size of the display panel becomes larger and the resolution increases, the digital driving method may have more favorable characteristics over the analog driving method. The method of compensating luminance according to some example embodiments may be applied to both of the analog driving method and the digital driving method.

The data driver 230 may apply a data signal to the display panel 210 through the data lines. The scan driver 240 may apply a scan signal to the display panel 210 through the scan lines.

The timing controller 250 may control the operation of the display device 200. The timing controller 250 may provide control signals to the data driver 230 and the scan driver 240 to control the operations of the display device 200. The control signals may be predetermined or preprogrammed. In some example embodiments, the data driver 230, the scan driver 240 and the timing controller 250 may be implemented as one integrated circuit (IC). In other example embodiments, the data driver 230, the scan driver 240 and the timing controller 250 may be implemented as two or more integrated circuits. A driving module including at least the timing controller 250 and the data driver 230 may be referred to as a timing controller embedded data driver (TED).

The timing controller 250 may receive the input image data IMG and the input control signals from the host processor 20. For example, the input image data may include red (R) image data, green (G) image data and blue (B) image data. According to some example embodiments, the input image data IMG may include white image data, magenta image data, yellow image data, cyan image data, and so on. In this disclosure, the input image data IMG is described using RGB data as an example, but the input image data IMG may include various color data other than the red, green and blue data. The input control signals may include a master clock signal, a data enable signal, a horizontal synchronization signal, a vertical synchronization signal, and so on.

The host processor 20 may provide a luminance setting value DBV indicating luminance information of the display panel 210 to the timing controller 250. The luminance setting value DBV may be determined automatically depending on the environmental luminance of the display device 200 or manually depending on the user input. The luminance setting value DBV may include dimming information that is determined according to the input image data IMG. For example, the luminance setting value DBV may indicate a maximum luminance value of the display panel 210.

The power supply 260 may supply the display panel 210 with a high power supply voltage ELVDD and a low power supply voltage ELVSS. In addition, the power supply 260 may supply a regulator voltage VREG to the gamma circuit 270.

The gamma circuit 270 may generate gamma reference voltages GRV based on the regulator voltage VREG. For example, the regulator voltage VREG may be the high power supply voltage ELVDD or a voltage that is generated by an additional voltage regulator.

The luminance compensation circuit 100 may be configured to perform the method of compensating for luminance in an electroluminescent display device. In some example embodiments, as illustrated in FIG. 5, the luminance compensation circuit 100 may be disposed between the timing controller 250 and the data driver 230. According to some example embodiments, the luminance compensation circuit 100 may be included in timing controller 250 or may be disposed at a front stage of the timing controller 250.

The luminance compensation circuit 100 may receive a plurality of input pixel values corresponding to the plurality of pixels included in the display panel 210 and generate a plurality of compensated pixel values respectively corresponding to the plurality of pixels by compensating for lateral leakage based on the leakage curve, where the lateral leakage is caused by leakage currents through a common conduction layer of the plurality of pixels. The data driver 230 may drive the plurality of pixels based on the plurality of compensated pixel values.

Figure 6:
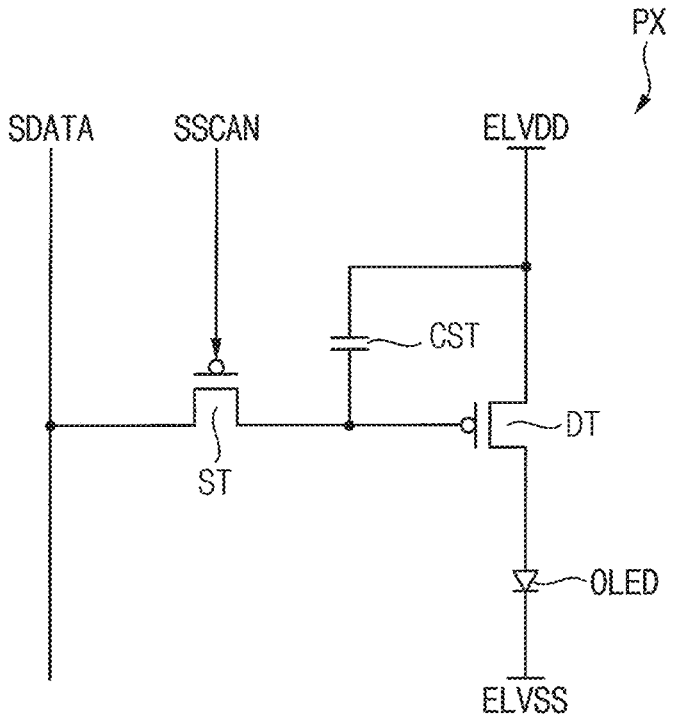
FIG. 6 is a circuit diagram illustrating an example embodiment of a pixel included in the electroluminescent display device of FIG. 5.

FIG. 6 is a circuit diagram illustrating an example embodiment of a pixel included in the electroluminescent display device of FIG. 5.

In some example embodiments, as illustrated in FIG. 6, each pixel PX of the display panel 210 may include a switching transistor ST, a storage capacitor CST, a driving transistor DT, and an OLED. The switching transistor ST has a first source/drain terminal connected to a data line, a second source/drain terminal connected to the storage capacitor CST, and a gate terminal connected to the scan line. The switching transistor ST transfers a data signal SDATA received from the data driver 230 to the storage capacitor CST based on a scan signal SSCAN from the scan driver 240. The storage capacitor CST stores the data signal SDATA transferred through the switching transistor ST. The driving transistor DT has a first source/drain terminal connected to a high power supply voltage ELVDD, a second source/drain terminal connected to the OLED, and a gate terminal connected to the storage capacitor CST. The driving transistor DT is turned on or off according to the data signal SDATA stored in the storage capacitor CST.

The OLED has an anode electrode connected to the driving transistor DT and a cathode electrode connected to a low power supply voltage ELVSS. The OLED emits light based on a current flowing from the high power supply voltage ELVDD to the low power supply voltage ELVSS while the driving transistor DT is turned on.

Figure 7:
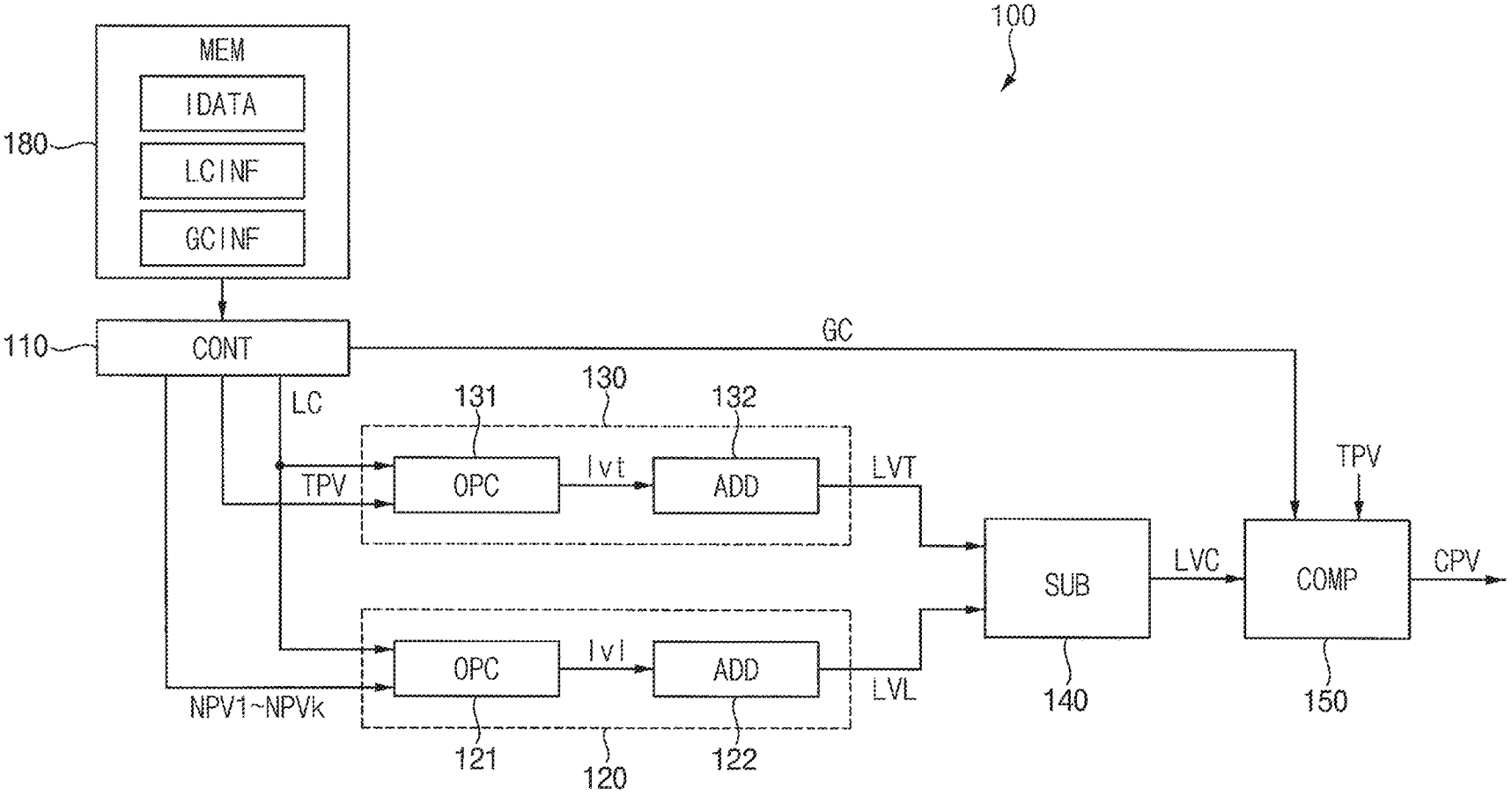
FIG. 7 is a block diagram illustrating an example embodiment of a luminance compensation circuit included in an electroluminescent display device according to some example embodiments.
Figure 8:
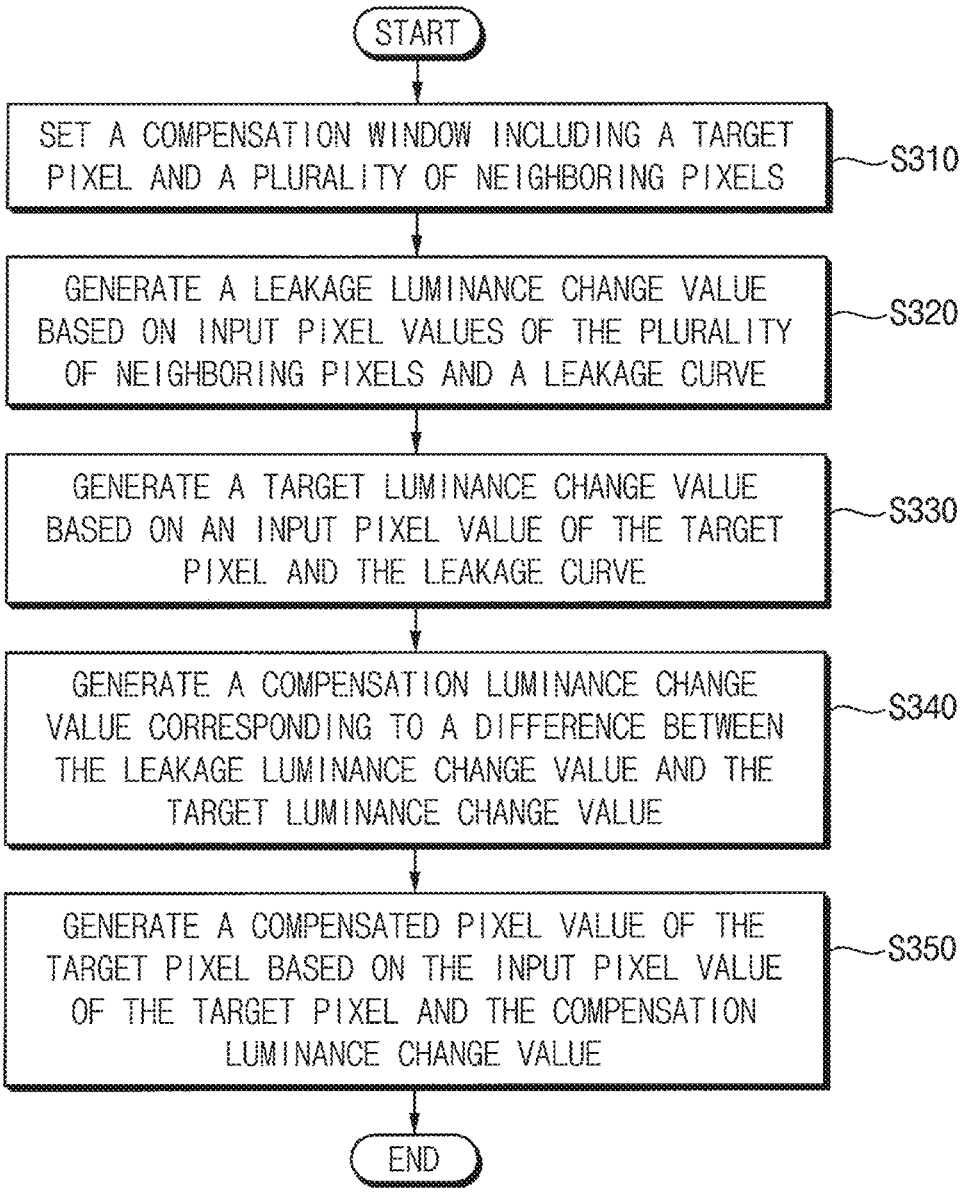
FIG. 8 is a flowchart illustrating a method of compensating for luminance in an electroluminescent display device according to some example embodiments.

FIG. 7 is a block diagram illustrating an example embodiment of a luminance compensation circuit included in an electroluminescent display device according to some example embodiments, and FIG. 8 is a flowchart illustrating a method of compensating for luminance in an electroluminescent display device according to some example embodiments.

Referring to FIG. 7, a luminance compensation circuit 100 may include a control logic CONT 110, a leakage operator 120, a target operator 120, a subtractor SUB 140, a compensator COMP 150 and a storage circuit MEM 180. According to example embodiments, the storage circuit 180 may be disposed outside the luminance compensation circuit 100.

The storage circuit 180 may store input data IDATA, leakage curve information LCINF and gamma curve information GCINF. The input data IDAT may include a plurality of input pixel values corresponding to a plurality of pixels included in a display panel. The input data IDAT may be the RGB data input to the timing controller 250 in FIG. 5, or the data processed by the timing controller 250. The leakage curve information LCINF may be the information on the leakage curve as will be described below with reference to FIGS. 12 and 13, and gamma curve information GCINF may be the information on the gamma curve as will be described below with reference to FIGS. 19 and 20.

Referring to FIGS. 7 and 8, the control logic 110 may set a compensation window including a target pixel and a plurality of neighboring pixels (S310). Example embodiments of the compensation window will be described with reference to FIGS. 9, 10 and 11. The control logic 110 may extract from the storage circuit 180, an input pixel value TPV of the target pixel and input pixel values NPV1~NPVk of the neighboring pixels to be provided to the leakage operator 120 and the target operator 130. In addition, the control logic 110 may extract from the storage circuit 180, first values LC associated with the leakage curve and second values GC associated with the gamma curve to be provided to the leakage operator 120, the target operator 130 and the compensator 150. The control logic 110 may control overall operations of the luminance compensation circuit 100.

The leakage operator 120 may generate a leakage luminance change value LVT based on the input pixel values NPV1~NPVk of the plurality of neighboring pixels and the leakage curve (S320). The leakage operator 120 may include a first operator OPC 121 and a first adder ADD 122. As will be described below with reference to FIG. 14, the first operator 121 may generate a per-pixel leakage luminance change value lvl corresponding to each neighboring pixel, and the first adder 122 may generate the leakage luminance change value LVL by summing a plurality of per-pixel leakage luminance change values lvl respectively corresponding to the plurality of neighboring pixels. The first operator 121 may generate the per-pixel leakage luminance change values lvl based on the first values LC associated with the leakage curve.

The target operator 130 may generate a target luminance change value LVT based on the input pixel value TPV of the target pixel and the leakage curve (S330). The target operator 130 may include a second operator 131 and a second adder 132. As will be described below with reference to FIG. 14, the second operator 131 may generate a per-pixel target luminance change value lvt corresponding to the target pixel and each neighboring pixel, and the second adder 132 may generate the target luminance change value LVT by summing a plurality of per-pixel target luminance change values lvt respectively corresponding to the target pixel and the plurality of neighboring pixels. The second operator 131 may generate the per-pixel target luminance change values lvl based on the first values LC associated with the leakage curve.

The subtractor 140 may generate a compensation luminance change value LVC corresponding to a difference between the leakage luminance change value LVL and the target luminance change value LVT (S340). In some example embodiments, the compensation luminance change value LVC may be obtained by subtracting the leakage luminance change value LVL from the target luminance change value LVT. In some example embodiments, the compensation luminance change value LVC may be obtained by subtracting the target luminance change value LVT from the leakage luminance change value LVL.

The compensator 150 may generate a compensated pixel value CPV of the target pixel based on the input pixel value TPV of the target pixel and the compensation luminance change value LVC (S350). The compensator 150 may generate the compensated pixel value CPV corresponding to the input pixel value TPV and the compensation luminance change value LVC, based on the second values GC associated with the gamma curve.

Figure 9:
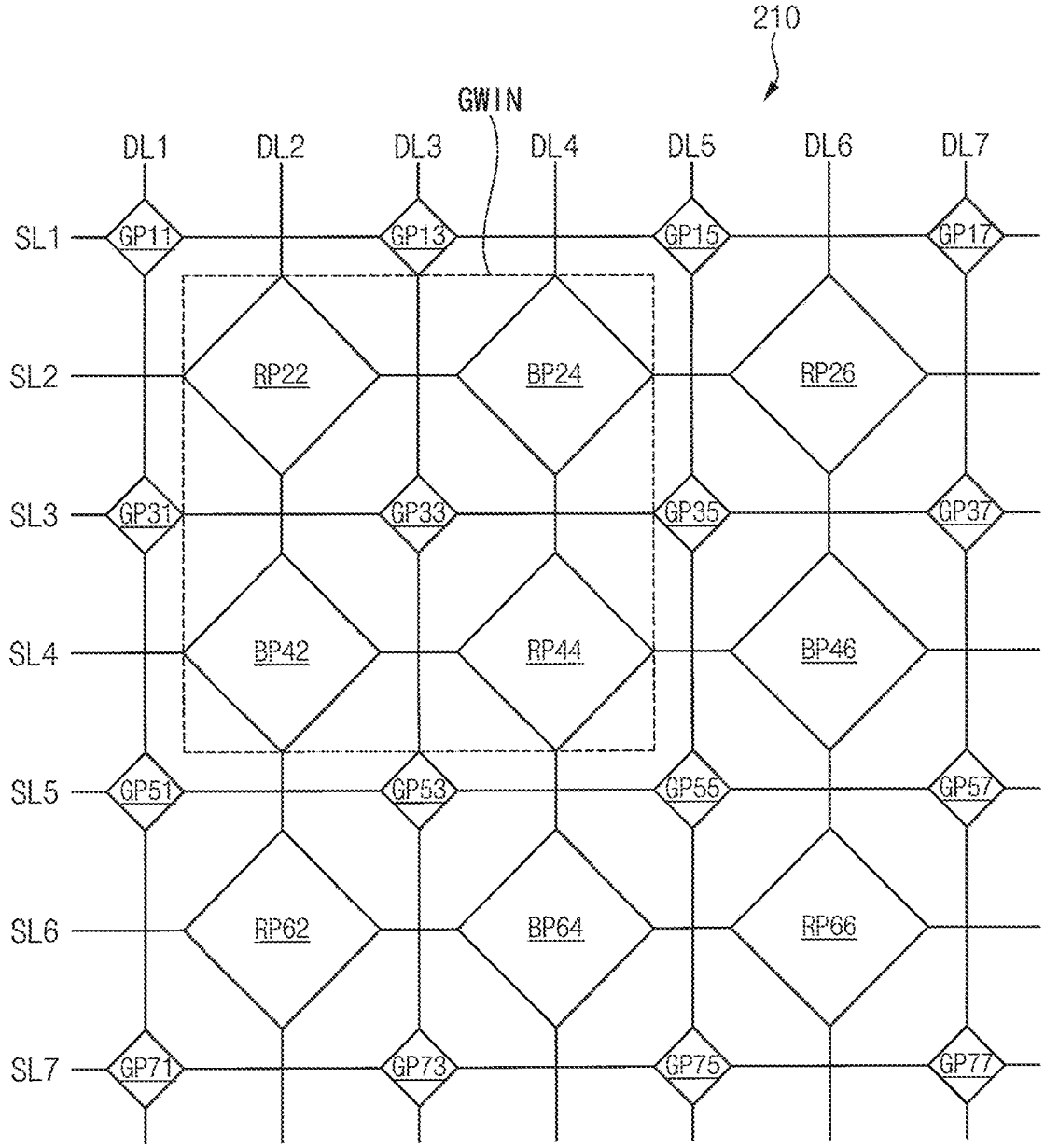
FIGS. 9, 10 and 11 are diagrams illustrating example embodiments of a display panel included in an electroluminescent display device according to some example embodiments.
Figure 10:
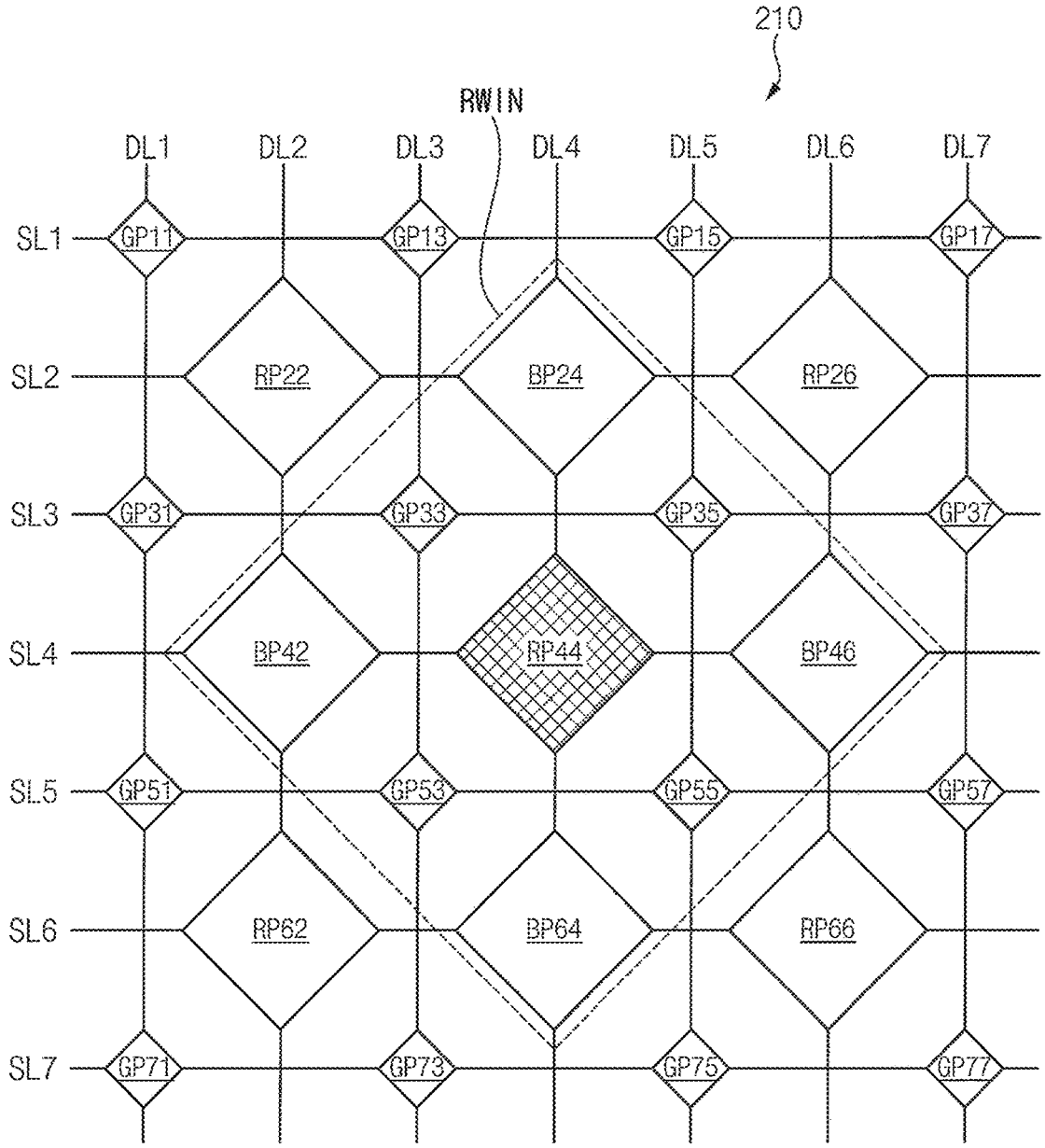
Figure 11:
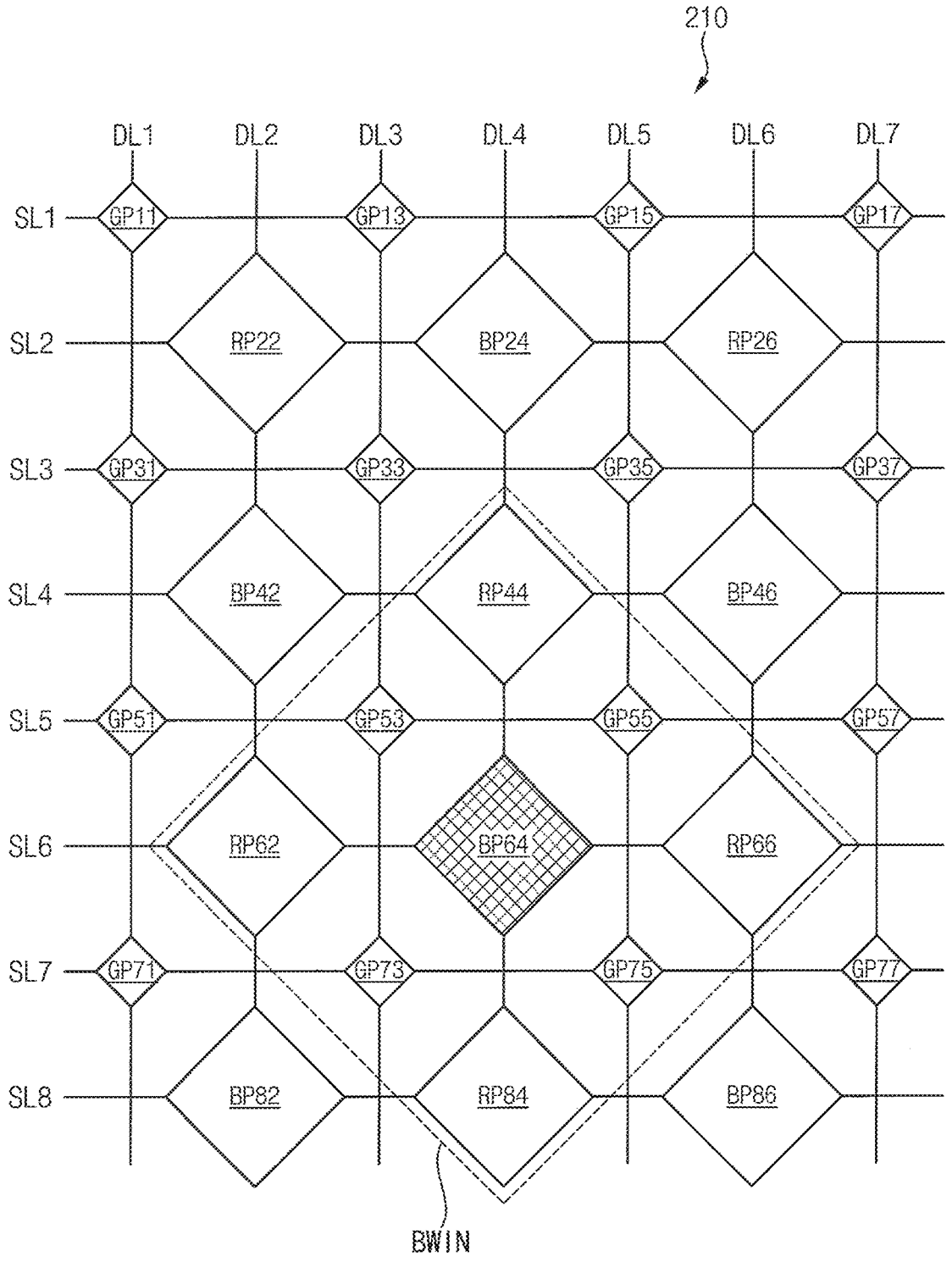

FIGS. 9, 10 and 11 are diagrams illustrating example embodiments of a display panel included in an electroluminescent display device according to some example embodiments.

FIGS. 9, 10 and 11 illustrate example layouts of the display panel 210

Referring to FIGS. 9, 10 and 11, a disposition example of the display panel 210 is partially illustrated. In FIGS. 9, 10 and 11, pixels are illustrated based on the positions of light emitting diodes of the display panel 210, and scan lines SL1~SL7 and data lines DL1~DL7 are illustrated so as to describe an electrical coupling relationship of the display panel 210.

Pixels RP22, RP26, RP44, RP62, and RP66 may be pixels emitting light of a red color. Pixels GP11, GP13, GP15, GP17, GP31, GP33, GP35, GP37, GP51, GP53, GP55, GP57, GP71, GP73, GP75, and GP77 may be pixels emitting light of a green color. Pixels BP24, BP42, BP46, and BP64 may be pixels emitting light of a blue color.

In some example embodiments, data voltages corresponding to grayscale voltages may be alternately applied to data lines DL1, DL3, DL5, and DL7 of a first group and data lines DL2, DL4, and DL6 of a second group.

For example, data voltages corresponding to the red color may be applied to the data lines DL1, DL3, DL5, and DL7 of the first group. When a scan signal of a turn-on level is applied to the scan line SL1, corresponding data voltages are written in the pixels GP11, GP13, GP15, and GP17. When a scan signal of a turn-on level is applied to the scan line SL3, corresponding data voltages are written in the pixels GP31, GP33, GP35, and GP37. When a scan signal of a turn-on level is applied to the scan line SL5, corresponding data voltages are written in the pixels GP51, GP53, GP55, and GP57. When a scan signal of a turn-on level is applied to the scan line SL7, corresponding data voltages are written in the pixels GP71, GP73, GP75, and GP77.

In addition, data voltages corresponding to the green color or the blue color may be applied to the data lines DL2, DL4, and DL6 of the second group. When a scan signal of a turn-on level is applied to the scan line SL2, corresponding data voltages are written in the pixels RP22, BP24, and RP26. When a scan signal of a turn-on level is applied to the scan line SL4, corresponding data voltages are written in the pixels BP42, RP44, and BP46. When a scan signal of a turn-on level is applied to the scan line SL6, corresponding data voltages are written in the pixels RP62, BP64, and RP66.

FIG. 9 illustrates an example embodiment of a compensation window GWIN when the target pixel is the green pixel GP33. In this case, the neighboring pixels may include the two red pixels RP22 and RP44 and the two blue pixels BP24 and BP42.

FIG. 10 illustrates an example embodiment of a compensation window RWIN when the target pixel is the red pixel RP44. In this case, the neighboring pixels may include the four green pixels GP33, GP35, GP53 and GP55 and the four blue pixels BP24, BP42, BP46 and BP64.

FIG. 11 illustrates an example embodiment of a compensation window BWIN when the target pixel is the blue pixel BP64. In this case, the neighboring pixels may include the four green pixels GP53, GP55, GP73 and GP75 and the four red pixels RP44, RP62, RP66 and RP84.

The setting of the compensation window is not limited to the example embodiments of FIGS. 9, 10 and 11, and the compensation window may be set using various methods.

Figures 12, 13:
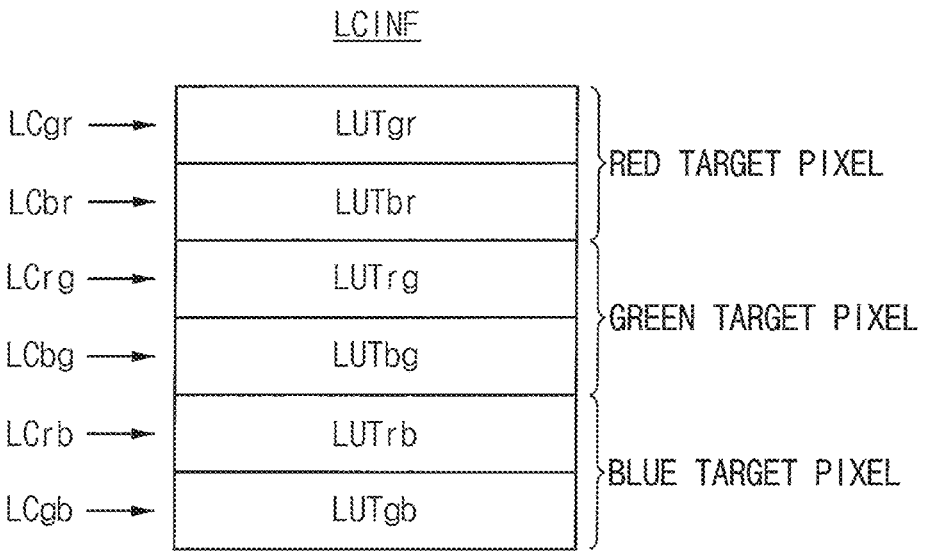
FIGS. 12 and 13 are diagrams illustrating an example embodiment of leakage curve information in a method of compensating for luminance in an electroluminescent display device according to some example embodiments.

FIGS. 12 and 13 are diagrams illustrating an example embodiment of leakage curve information in a method of compensating for luminance in an electroluminescent display device according to some example embodiments.

Referring to FIG. 12, the leakage curve information LCINF may include a plurality of lookup tables corresponding to a plurality of color leakage curves. The above-described leakage curve may include the plurality of color leakage curves respectively corresponding to different combinations of the target color of the target pixel and the neighboring color of the neighboring pixel.

A first lookup table LUTgr may correspond to a first color leakage curve LCgr when the target pixel is the red pixel and the neighboring pixel is the green pixel. A second lookup table LUTbr may correspond to a second color leakage curve LCbr when the target pixel is the red pixel and the neighboring pixel is the blue pixel. The first lookup table LUTgr and the second lookup table LUTbr may be used to compensate the input pixel value of the red target pixel.

A third lookup table LUTrg may correspond to a third color leakage curve LCrg when the target pixel is the green pixel and the neighboring pixel is the red pixel. A fourth lookup table LUTbg may correspond to a fourth color leakage curve LCbg when the target pixel is the green pixel and the neighboring pixel is the blue pixel. The third lookup table LUTrg and the fourth lookup table LUTbg may be used to compensate the input pixel value of the green target pixel.

A fifth lookup table LUTrb may correspond to a fifth color leakage curve LCrb when the target pixel is the blue pixel and the neighboring pixel is the red pixel. A sixth lookup table LUTgb may correspond to a sixth color leakage curve LCgb when the target pixel is the blue pixel and the neighboring pixel is the green pixel. The fifth lookup table LUTrb and the sixth lookup table LUTgb may be used to compensate the input pixel value of the blue target pixel.

FIG. 13 illustrates an example of the third lookup table LUTrg in FIG. 12. The third lookup table LUTrg may indicate mapping relations between the gray scale value GSV and the luminance change value ΔLV. The third lookup table LUTrg may include a plurality of grayscale values g1~gs and a plurality of luminance change values I1~Is respectively corresponding to the plurality of grayscale values g1~gs. As such, each of (or alternatively, at least one of) the first through sixth lookup tables LUTgr, LUTbr, LUTrg, LUTrb, LUTrb and LUTgb in FIG. 12 may include a plurality of grayscale values and a plurality of luminance change values respectively corresponding to the plurality of grayscale values.

Figure 14:
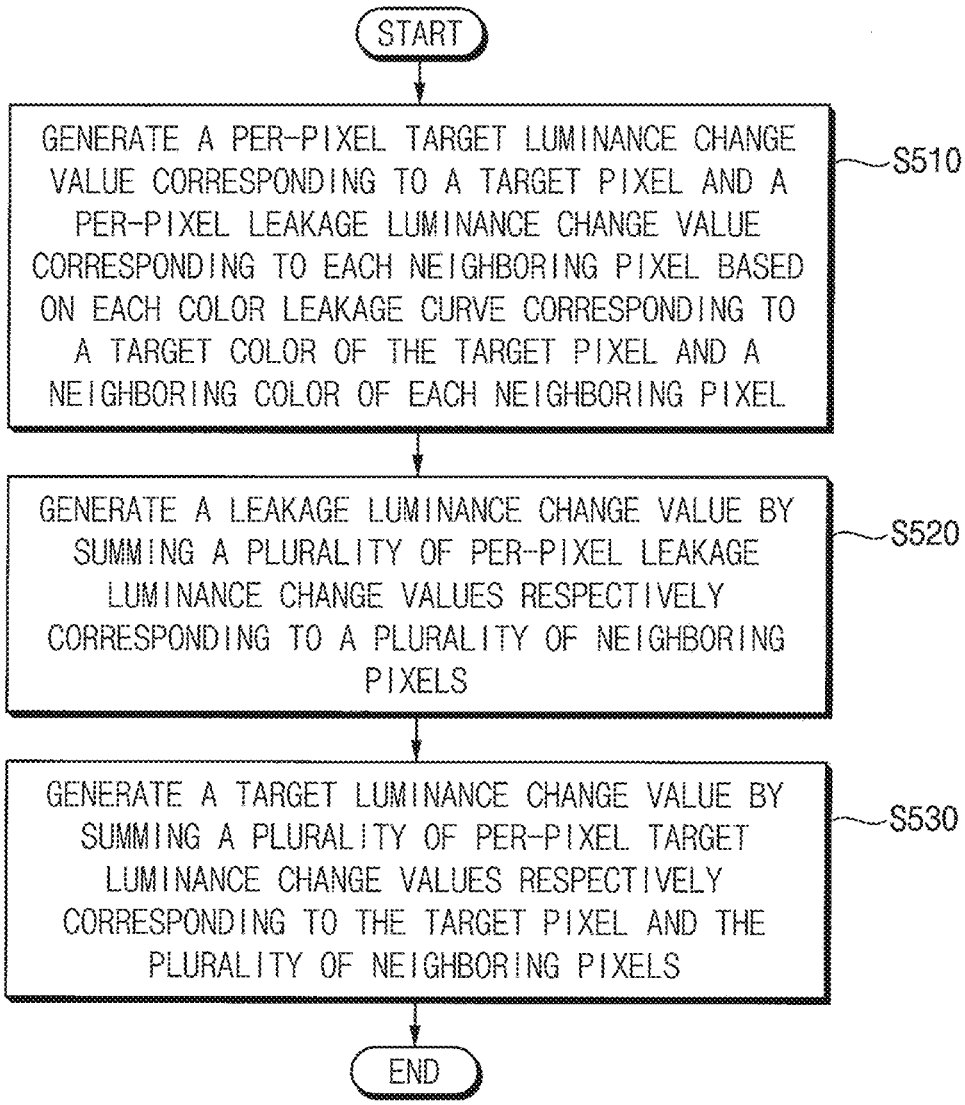
FIG. 14 is a flowchart illustrating an example embodiment of generating a leakage luminance change value and a target luminance change value in a method of compensating for luminance in an electroluminescent display device according to some example embodiments.

FIG. 14 is a flowchart illustrating an example embodiment of generating a leakage luminance change value and a target luminance change value in a method of compensating for luminance in an electroluminescent display device according to some example embodiments.

Referring to FIGS. 7 and 14, the first and second operators 121 and 131 included in the leakage operator 120 and the target operator 130 may generate the per-pixel target luminance change value lvt corresponding to the target pixel and the per-pixel leakage luminance change value lvl corresponding to each neighboring pixel based on each color leakage curve corresponding to the target color of the target pixel and the neighboring color of each neighboring pixel (S510).

The first adder 122 in the leakage operator 120 may generate the leakage luminance change value LVL by summing the plurality of per-pixel leakage luminance change values lvl respectively corresponding to the plurality of neighboring pixels (S520).

The second adder 132 in the target operator 130 may generate the target luminance change value LVT by summing the plurality of per-pixel target luminance change values lvt respectively corresponding to the target pixel and the plurality of neighboring pixels (S530).

Hereinafter, example embodiments are further described in detail with reference to FIGS. 15, 16, 17 and 18, with an example that the target pixel is the green pixel.

Figure 15:
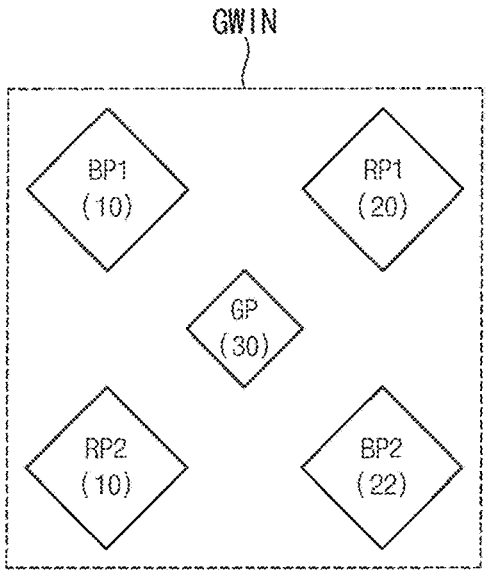
FIG. 15 is a diagram illustrating an example embodiment of a compensation window in a method of compensating for luminance in an electroluminescent display device according to some example embodiments.
Figure 16:
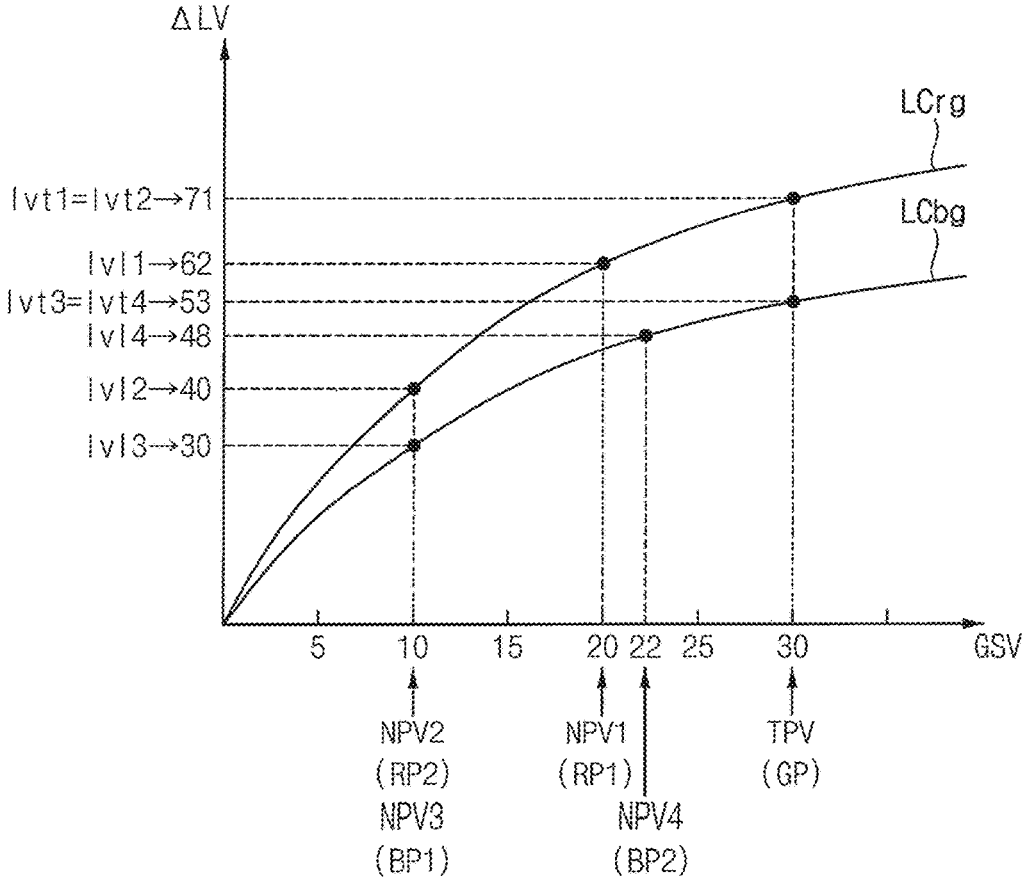
FIG. 16 is a diagram illustrating an example embodiment of generating a leakage luminance change value and a target luminance change value corresponding to the compensation window of FIG. 15.

FIG. 15 is a diagram illustrating an example embodiment of a compensation window in a method of compensating for luminance in an electroluminescent display device according to some example embodiments, and FIG. 16 is a diagram illustrating an example embodiment of generating a leakage luminance change value and a target luminance change value corresponding to the compensation window of FIG. 15.

Referring to FIGS. 15 and 16, the compensation window GWIN may include a target pixel corresponding to a green pixel GP, and four neighboring pixels corresponding to first and second red pixels RP1 and RP2 and first and second blue pixels BP1 and BP2.

As an example, it may be assumed the input pixel value TPV of the green pixel GP may be 30, the input pixel value NPV1 of the first red pixel RP1 may be 20, the input pixel value NPV2 of the second red pixel RP2 may be 10, the input pixel value NPV3 of the first blue pixel BP1 may be 10 and the input pixel value NPV4 of the blue pixel BP2 may be 22.

As illustrated in FIG. 16, the third color leakage curve LCrg in FIG. 12 may be used with respect to the first and second red pixels RP1 and RP2, and the fourth color leakage curve LCbg in FIG. 12 may be used with respect to the first and second blue pixels BP1 and BP2, to compensate for the green pixel GP corresponding to the target pixel.

For example, first through fourth per-pixel target luminance change values lvt1~lvt4 may be 71, 71, 53 and 53, which are obtained using the third color leakage curve LCrg and the fourth color leakage curve LCbg with respect to the input pixel value TPV of 10 of the target pixel. In addition, first through fourth per-pixel leakage luminance change values lvl1~lvl4 may be 62, 40, 30 and 48, which are obtained using the third color leakage curve LCrg and the fourth color leakage curve LCbg with respect to the input pixel values NPV1~NPV4 of 20, 10, 10 and 22 of the neighboring pixels.

The first through fourth per-pixel target luminance change values lvt1~lvt4 may be summed to obtain the target luminance change value LVT of 248 (=71+71+53+53), and the first through fourth per-pixel leakage luminance change values lvl1~lvl4 may be summed to obtain the leakage luminance change value LVL of 180 (=62+40+30+48). Finally, the leakage luminance change value LVL may be subtracted from the target luminance change value LVT to obtain the compensation luminance change value LVC of 68 (=248-180).

When the leakage luminance change value LVL is smaller than the target luminance change value LVT, the compensated pixel value of the target pixel may be by increasing the input pixel value of the target pixel. In contrast, when the leakage luminance change value LVL is greater than the target luminance change value LVT, the compensated pixel value of the target pixel may be generated by decreasing the input pixel value of the target pixel. Such generation of the compensated pixel value will be further described with reference to FIG. 18.

Figure 17:
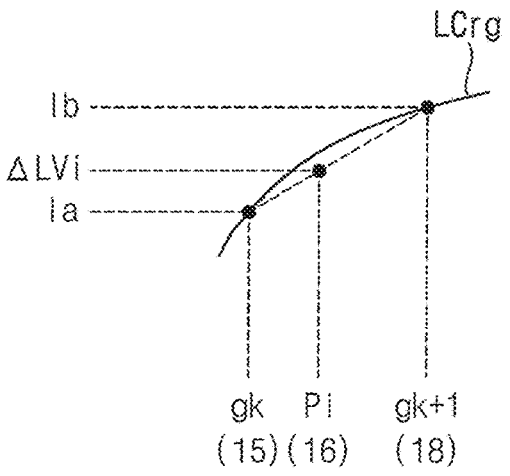
FIG. 17 is a diagram illustrating an example embodiment of interpolation in a method of compensating for luminance in an electroluminescent display device according to some example embodiments.

FIG. 17 is a diagram illustrating an example embodiment of interpolation in a method of compensating for luminance in an electroluminescent display device according to some example embodiments.

Referring to FIG. 17, the per-pixel leakage luminance change value or the per-pixel target luminance value corresponding to the target pixel may be generated by performing interpolation based on grayscale values adjacent to an input pixel value of each neighboring pixel or an input pixel value of the target pixel among the plurality of scale values g1~gs included in each lookup table, for example, the third lookup table LUTrg corresponding to the third color leakage curve LCrg of FIG. 13.

For example, as illustrated in FIG. 17, with respect to the luminance change values la and lb corresponding to the grayscale values gk and gk+1 of 15 and 18, the luminance change value ΔLVi corresponding to the input pixel value Pi of 16 may be determined as la+(lb−la)/3.

Figure 18:
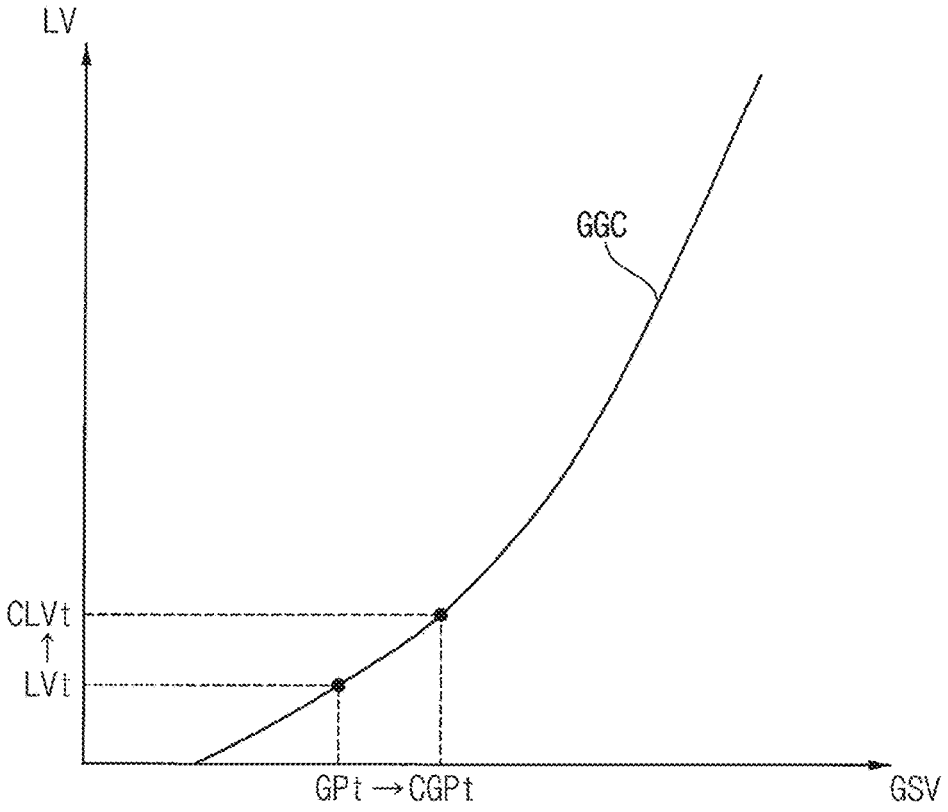
FIG. 18 is a diagram illustrating an example embodiment of generating a compensated pixel value in a method of compensating for luminance in an electroluminescent display device according to some example embodiments.

FIG. 18 is a diagram illustrating an example embodiment of generating a compensated pixel value in a method of compensating for luminance in an electroluminescent display device according to some example embodiments.

In FIG. 18, the horizontal axis indicates grayscale value GSV and the vertical axis indicates luminance value LV. FIG. 18 illustrates an example that the compensated pixel value is generated using the green light curve or the green gamma curve GGC when the target pixel is the green pixel.

Referring to FIG. 18, the compensated pixel value CGPt corresponding to the input pixel value GPt of the target pixel and the compensation luminance change value LVC may be generated based on the gamma curve GGC corresponding to the target color of the target pixel. When the compensation luminance change value LVC is positive, that is, when the leakage luminance change value LVL is smaller than the target luminance change value LVT as the example of FIGS. 15 and 16, the input pixel value GVt may be increased to generate the compensated pixel value CGPt, so that the luminance value LVt corresponding to the input pixel value GVt may be increased to the luminance value CLVt corresponding to the compensated pixel value CGPt.

Figure 19:
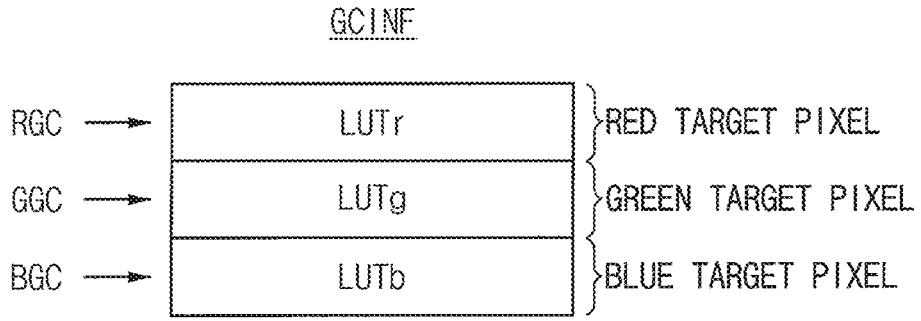

FIGS. 19 and 20 are diagrams illustrating an example embodiment of gamma curve information in a method of compensating for luminance in an electroluminescent display device according to some example embodiments.

Referring to FIG. 19, the gamma curve information GCINF may include a plurality of lookup tables that represent a plurality of color gamma curves corresponding to a plurality of colors. The plurality of color gamma curves may be the single color light curves RGC, GGC and BGC as described with reference to FIG. 3.

A red lookup table LUTr may represent a red light curve or a red gamma curve RGC corresponding to the red target pixel, which are used to compensate the input pixel value of the red target pixel. A green lookup table LUTg may represent a green light curve or a green gamma curve GGC corresponding to the green target pixel, which are used to compensate the input pixel value of the green target pixel. A blue lookup table LUTb may represent a blue light curve or a blue gamma curve BGC corresponding to the blue target pixel, which are used to compensate the input pixel value of the blue target pixel.

FIG. 20 illustrates an example of the green lookup table LUTg in FIG. 10. The green lookup table LUTg may be a two-dimensional lookup table including a plurality of compensated grayscale values respectively corresponding to different combinations of a grayscale value GSV and a compensation luminance change value LVC. For example, the gray scale value GSV may include a plurality of values g1~gm, and the compensation luminance change value LVC may include a plurality of negative values −l1~−lg and a plurality of positive values l1~lp. As illustrated in FIG. 20, the green lookup table LUTg may include a plurality of compensated grayscale values cg1~cg24 respectively corresponding to different combination of the grayscale value GSV and the compensation luminance change value LVC. For example, when the input pixel value of the target pixel is g3 and the compensation luminance change value LVC that is obtained as described above is l2, the compensated pixel value of the target pixel may be determined as cg19. The compensated pixel value cg19 may be greater than the input pixel value g3 when the compensation luminance change value LVC is a positive value. As another example, when the input pixel value of the target pixel is g2 and the compensation luminance change value LVC that is obtained as described above is −l1, the compensated pixel value of the target pixel may be determined as cg10. The compensated pixel value cg10 may be smaller than the input pixel value g2 when the compensation luminance change value LVC is a negative value.

As such, both of the positive compensation and the negative compensation may be possible according to some example embodiments. The compensated luminance range may not be clipped and the targeted luminance may be realized regardless of the input pixel values of the neighboring pixels.

Figure 21:
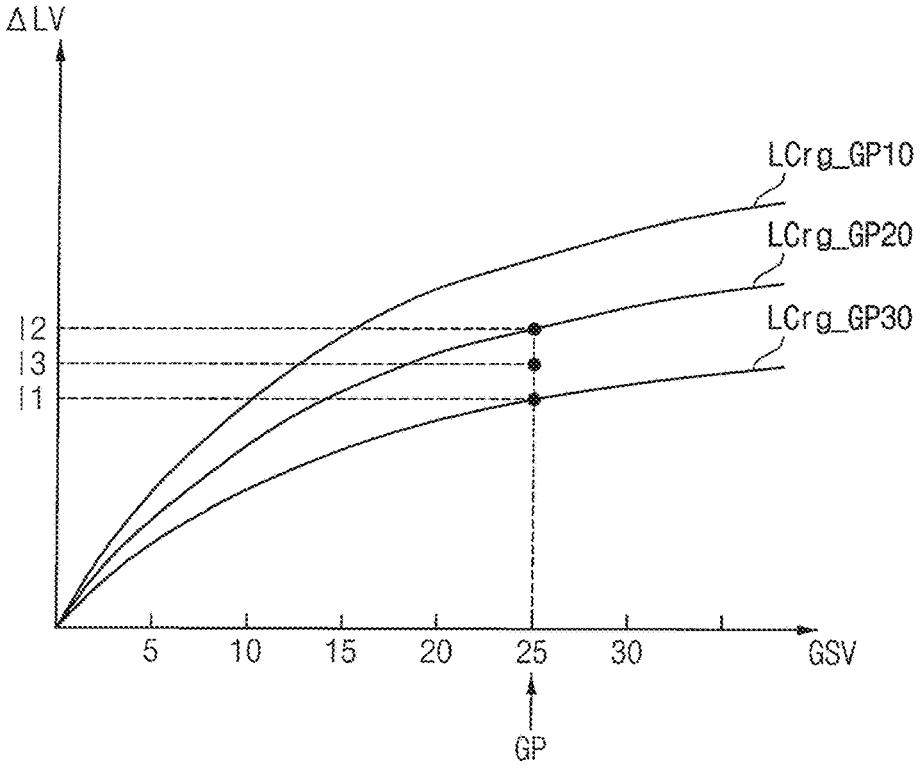
FIGS. 21 and 22 are diagrams illustrating example embodiments of a leakage curve in a method of compensating for luminance in an electroluminescent display device according to some example embodiments.
Figure 22:
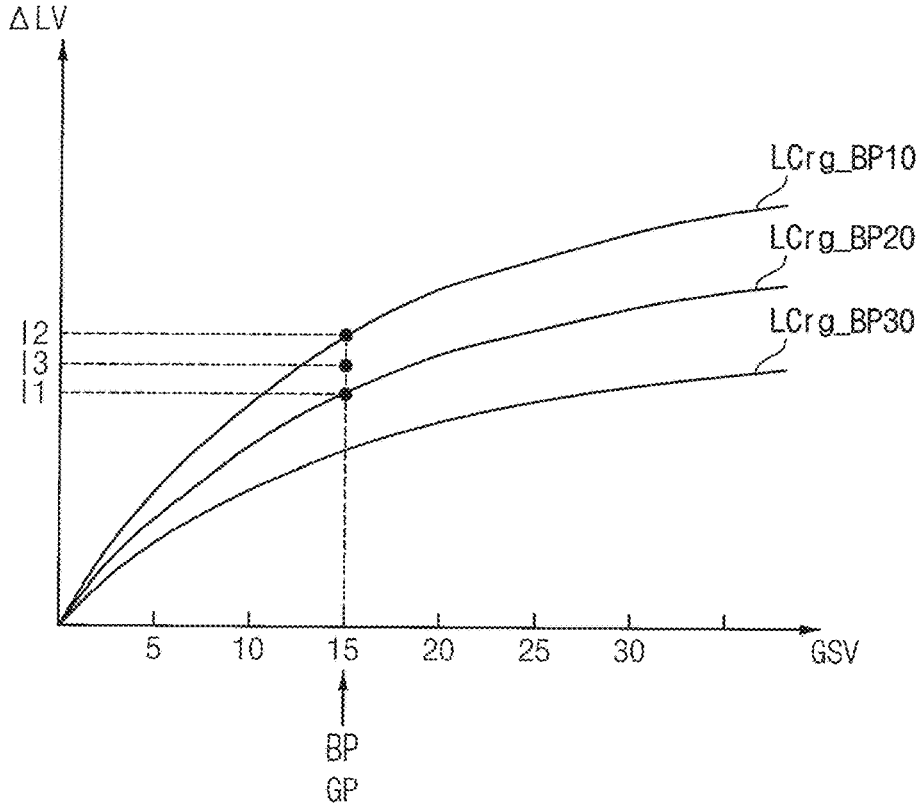

FIGS. 21 and 22 are diagrams illustrating example embodiments of a leakage curve in a method of compensating for luminance in an electroluminescent display device according to some example embodiments.

FIGS. 21 and 22 illustrate example embodiments corresponding to the third color leakage curve LCrg among the plurality of color leakage curves in FIG. 12. It will be easily understood that the example embodiments of FIGS. 21 and 22 may be applied to each of (or alternatively, at least one of) the plurality of color leakage curves in FIG. 12.

Referring to FIG. 21, each color leakage curve may include two or more target color leakage curves respectively corresponding to two or more grayscale values of the target pixel. For example, as illustrated in FIG. 21, the third color leakage curve LCrg may include three target color leakage curves LCrg_GP10, LCrg_GP20 and LCrg_GP30, which are obtained by measuring the luminance change value ΔLV while the grayscale value of the green pixel GP corresponding to the target pixel to each of (or alternatively, at least one of) 10, 20 and 30 and the grayscale value of the red pixel corresponding to the neighboring pixel is changed.

When the input pixel value of the target pixel GP does not coincide with one of the grayscale values of 10, 20 and 30, the lateral leakage may be compensated for by performing interpolation based on the target color leakage curves LCrg_GP10, LCrg_GP20 and LCrg_GP30.

For example, as illustrated in FIG. 21, when the input pixel value of the target pixel GP is 25, the per-pixel target luminance change value of l3 (=(l1+l2)/2) may be obtained by performing the interpolation based on the two target color leakage curves LCrg_GP20 and LCrg_GP30.

Referring to FIG. 22, each color leakage curve may include two or more reference color leakage curves respectively corresponding to two or more grayscale values of a reference neighboring pixel corresponding to a reference color that is different from the target color and the neighboring color.

FIG. 22 illustrates an example that the target color is the green color, the neighboring color is the red color, and the reference color is the blue color. For example, as illustrated in FIG. 22, the third color leakage curve LCrg may include three reference color leakage curves LCrg_BP10, LCrg_BP20 and LCrg_BP30, which are obtained by measuring the luminance change value ΔLV while the grayscale value of the blue pixel BP corresponding to the reference neighboring pixel to each of (or alternatively, at least one of) 10, 20 and 30, and the grayscale value of the red pixel corresponding to the neighboring pixel is changed.

When the input pixel value of the reference neighboring pixel BP does not coincide with one of the grayscale values of 10, 20 and 30, the lateral leakage may be compensated for by performing interpolation based on the reference color leakage curves LCrg_BP10, LCrg_BP20 and LCrg_BP30.

For example, as illustrated in FIG. 22, when the input pixel value of the target pixel GP is 15 and the input pixel value of the reference neighboring pixel BP is 15, the per-pixel target luminance change value of l3 (=(l1+l2)/2) may be obtained by performing the interpolation based on the two reference color leakage curves LCrg_BP10 and LCrg_BP20.

Figure 23:
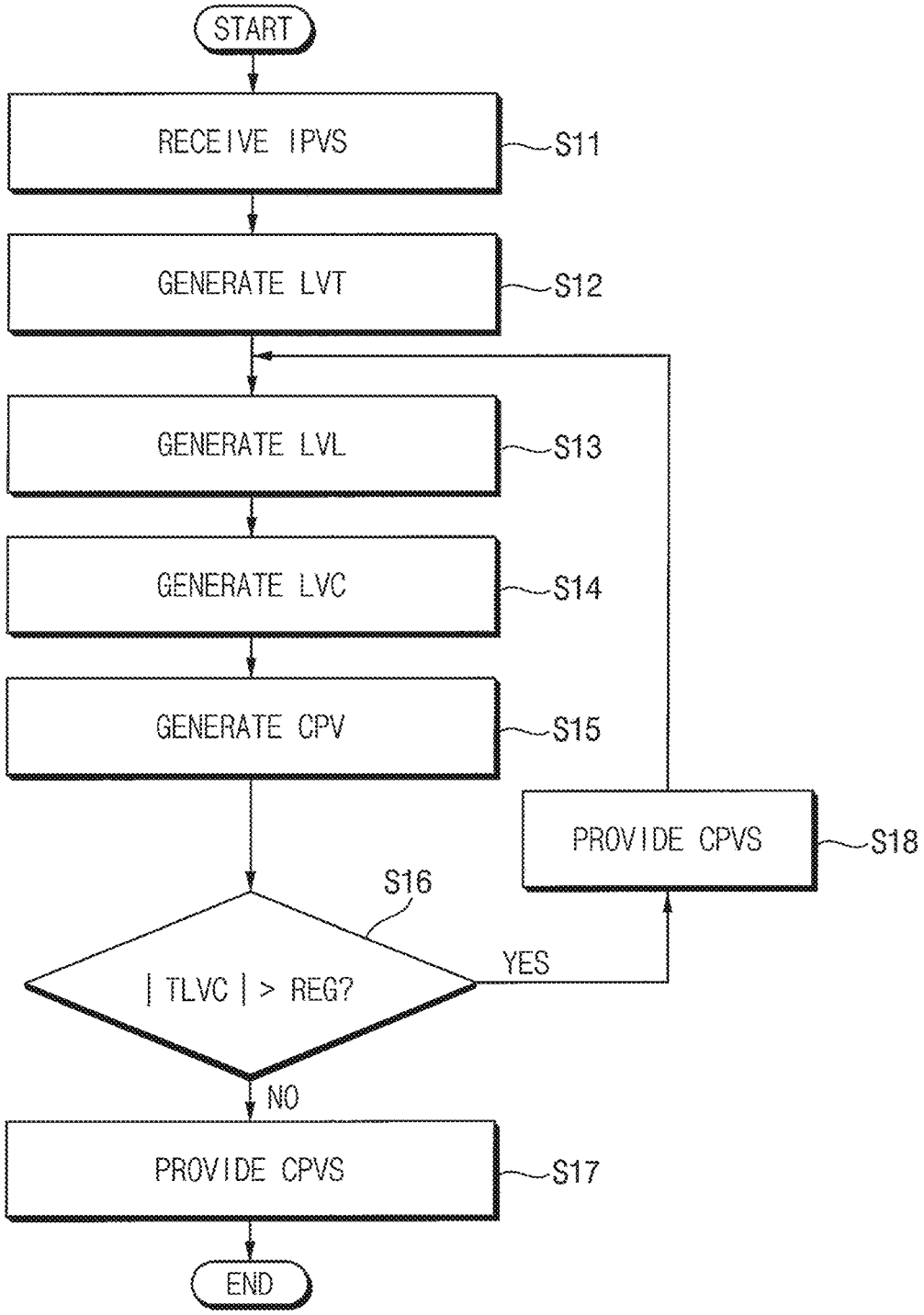
FIG. 23 is a flow chart illustrating a method of compensating for luminance in an electroluminescent display device according to some example embodiments.

FIG. 23 is a flow chart illustrating a method of compensating for luminance in an electroluminescent display device according to some example embodiments. Hereinafter, descriptions repeated with the above descriptions may be omitted.

Referring to FIG. 23, the luminance compensation circuit 100 as described with reference to FIG. 7 may receive the plurality of input pixel values IPVS (S11), generate the target luminance change value LVT (S12) and generate the leakage luminance change value LVL (S13), as described above. The luminance compensation circuit 100 may generate the compensation luminance change value LVC corresponding to the difference between the leakage luminance change value LVL and the target luminance change value LVT (S14), and generate the compensated pixel value CPV of the target pixel based on the input pixel value of the target pixel and the compensation luminance change value LVC (S15). As such, the plurality of compensated pixel values CPVS corresponding to the plurality of pixels may be generated by performing the operations S12, S13, S14 and S15 with respect to each of (or alternatively, at least one of) the plurality of pixels.

In some example embodiments, the luminance compensation circuit 100 may compare an absolute value |TLVC| of a sum of the plurality of compensation luminance change values LVC with a reference value REG (S16).

When the absolute value |TLVC| is greater than the reference value REG (S16: YES), the luminance compensation circuit 100 may correct the plurality of compensated pixel values CPVS. When the plurality of compensated pixel values CPVS are corrected, the compensated pixel values CPVS corresponding to the neighboring pixels may be provided to the leakage operator 120 in FIG. 7 (S18) to update the leakage luminance change value LVL based on the compensated pixel values CPVS corresponding to the neighboring pixels. In contrast, the target luminance change value LVT that is based on the input pixel value of the target pixel may not be changed.

When the absolute value |TLVC| is not greater than the reference value REG (S16: NO), the plurality of compensated pixel values CPVS may be provided to the data driver 230 (S17).

Figure 24:
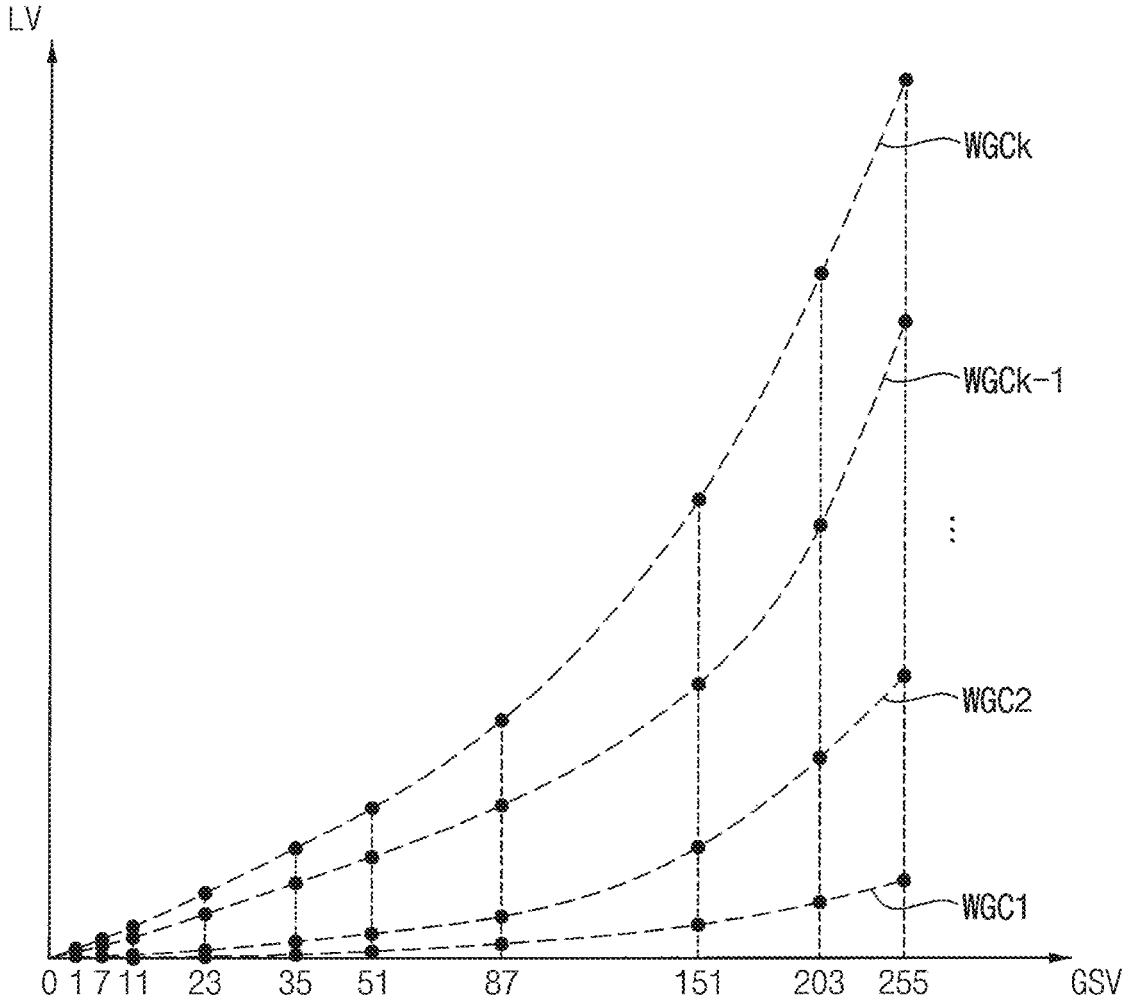
FIG. 24 is a diagram illustrating gamma characteristics of an electroluminescent display device according to some example embodiments.

FIG. 24 is a diagram illustrating gamma characteristics of an electroluminescent display device according to some example embodiments.

In FIG. 24, the horizontal axis indicates grayscale value GSV and the vertical axis indicates luminance value LV. Referring to FIG. 24, maximum luminance values of the white color light curves WGC1~WGCk may be different from each other. For example, the maximum luminance of the white color light curve WGC1 may be lowest, and the maximum luminance value of the white color light curve WGCk may be highest.

To generate white light, it is assumed that the pixels in the display panel receive data voltages with respect to the same grayscale. As illustrated in FIG. 24, as the maximum luminance value is decreased, the gamma curve is lowered and the compensation for the high grayscale may not affect largely.

Accordingly, the luminance compensation circuit 100 may output the input pixel value of the target pixel as the compensated pixel value of the target pixel when the input pixel value of the target pixel is greater than a reference grayscale value that is predetermined (or alternatively, desired). In some example embodiments, the luminance compensation circuit 100 may decrease the reference grayscale value as a target luminance or the maximum luminance value of the electroluminescent display device is increased.

Figure 25:
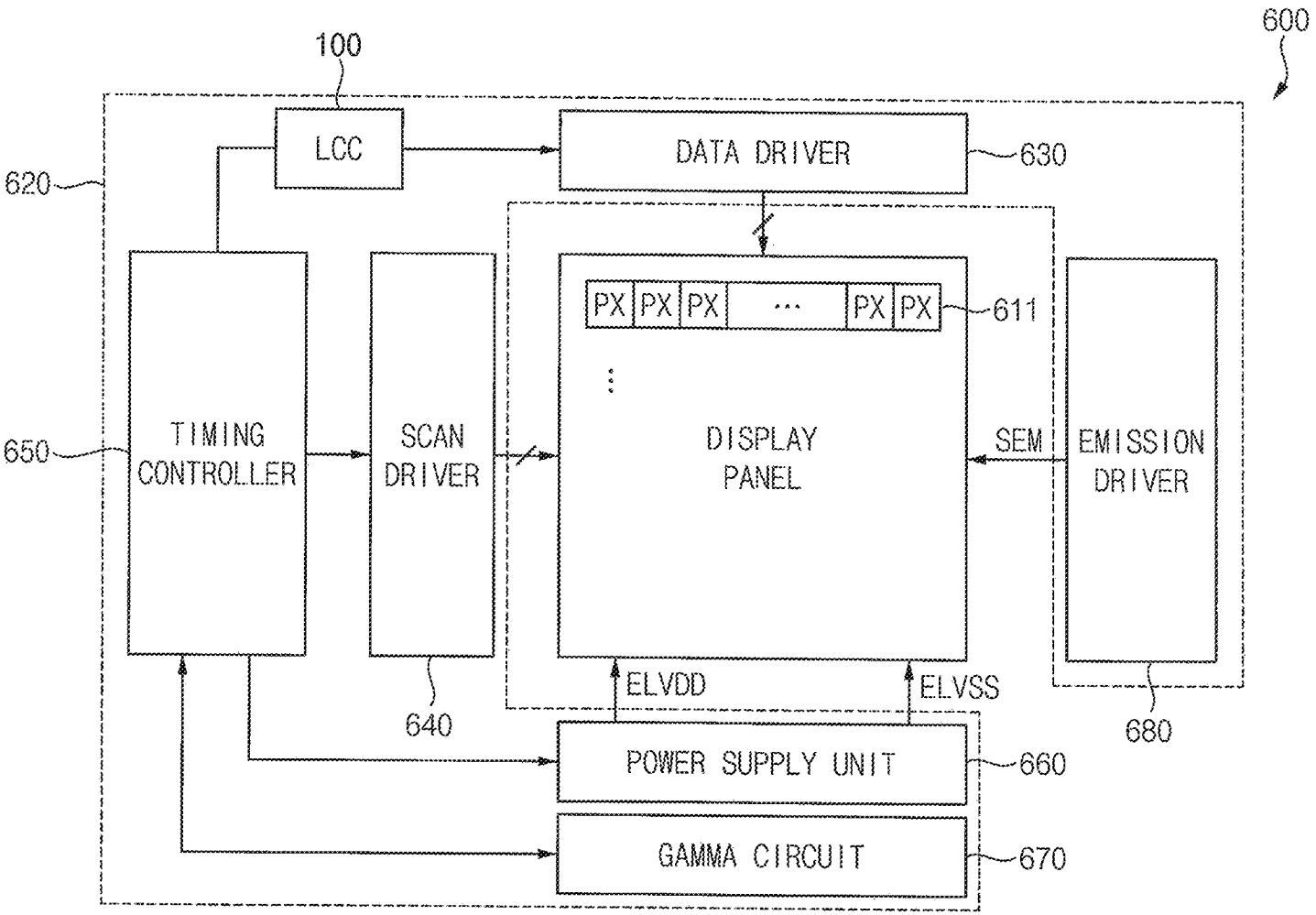
FIG. 25 is a block diagram illustrating an electroluminescent display device according to some example embodiments.
Figure 26:
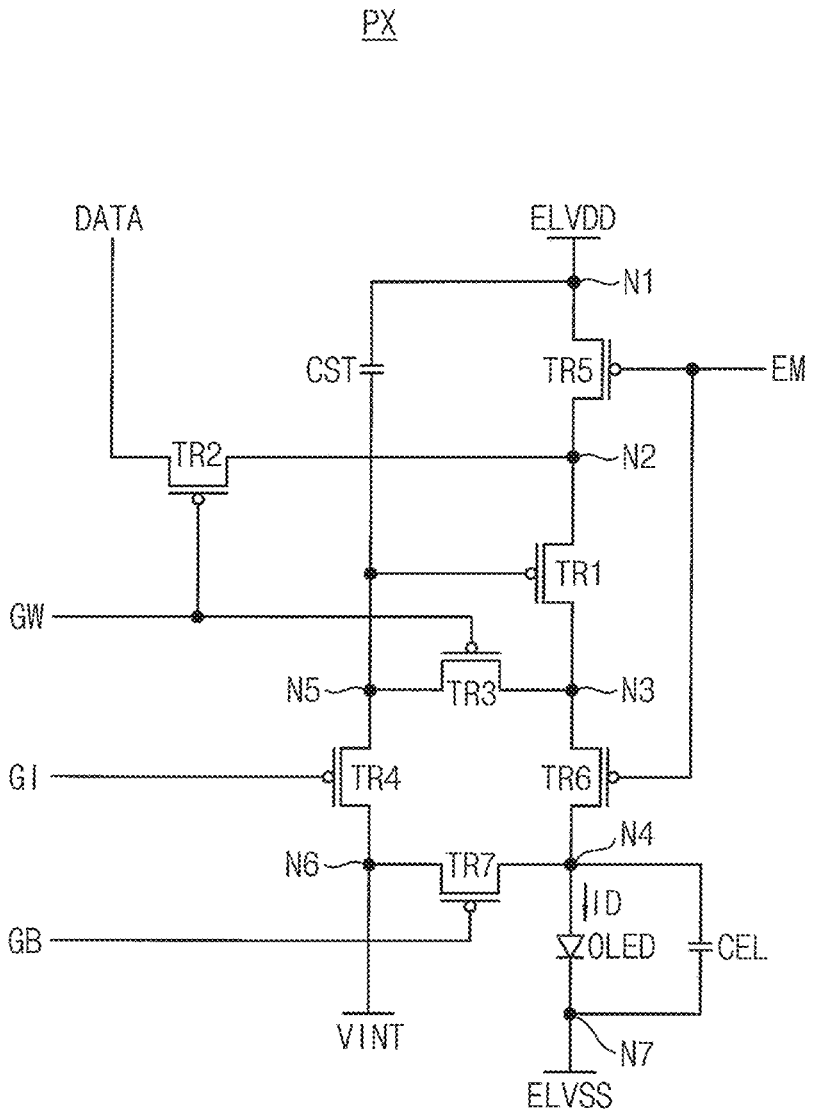
FIG. 26 is a circuit diagram illustrating an example embodiment of a pixel included in the electroluminescent display device of FIG. 25.

FIG. 25 is a block diagram illustrating an electroluminescent display device according to some example embodiments, and FIG. 26 is a circuit diagram illustrating an example embodiment of a pixel included in the electroluminescent display device of FIG. 25.

Referring to FIG. 25, a display device 600 may include a display panel 610 having a plurality of pixel rows 611 and a driving unit 620 that drives the display panel 610. The driving unit 620 may include a data driver 630, a scan driver 640, a timing controller 650, a power supply unit 660, a current detection unit 670, an emission driver 680, and a voltage controller 651. The display device 600 may have a configuration similar to the display device 200 of FIG. 5, except that the display device 600 further includes the emission driver 680 and each pixel PX of FIG. 26 further includes an emission control transistor. The descriptions repeated with FIGS. 5 and 6 may be omitted.

The emission control driver 680 may simultaneously (or alternatively, contemporaneously) apply an emission control signal SEM to all pixels PX in the display panel 610 to control all pixels PX to simultaneously (or alternatively, contemporaneously) emit or not to emit light. For example, the emission control driver 680 may simultaneously (or alternatively, contemporaneously) apply the emission control signal SEM having a first voltage level to all pixels PX during a non-emission time to prevent or hinder all pixels PX from emitting light, and may simultaneously (or alternatively, contemporaneously) apply the emission control signal SEM having a second voltage level to all pixels PX during an emission time to induce all pixels PX to simultaneously (or alternatively, contemporaneously) emit light.

Each pixel PX may or may not emit light based on the emission control signal SEM. In some example embodiments, as illustrated in FIG. 26, each pixel PX may include transistors TR1~TR7 operating based on data and control signals GW, GI, GB and EM, a storage capacitor CST, and an OLED, which connected between nodes N1~N7 and voltages VINT, ELVSS and ELVDD. For example, the emission control transistors TP5 and TP6 may be turned off when the emission control signal EM has the first voltage level and may be turned on when the emission control signal EM has the second voltage level. The OLED may emit light based on a current flowing from the high power supply voltage ELVDD to the low power supply voltage ELVSS while the drive transistor TR1 and the emission control transistors TR5 and TR6 are turned on.

Figure 27:
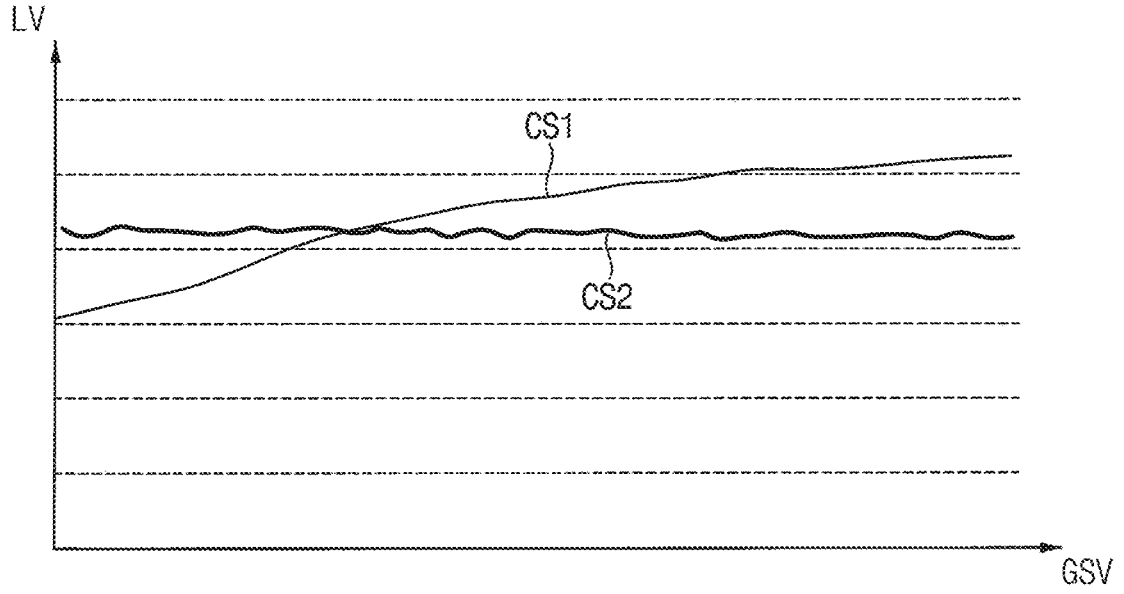
FIGS. 27 and 28 are diagrams illustrating luminance compensation of an electroluminescent display device according to some example embodiments.
Figure 28:
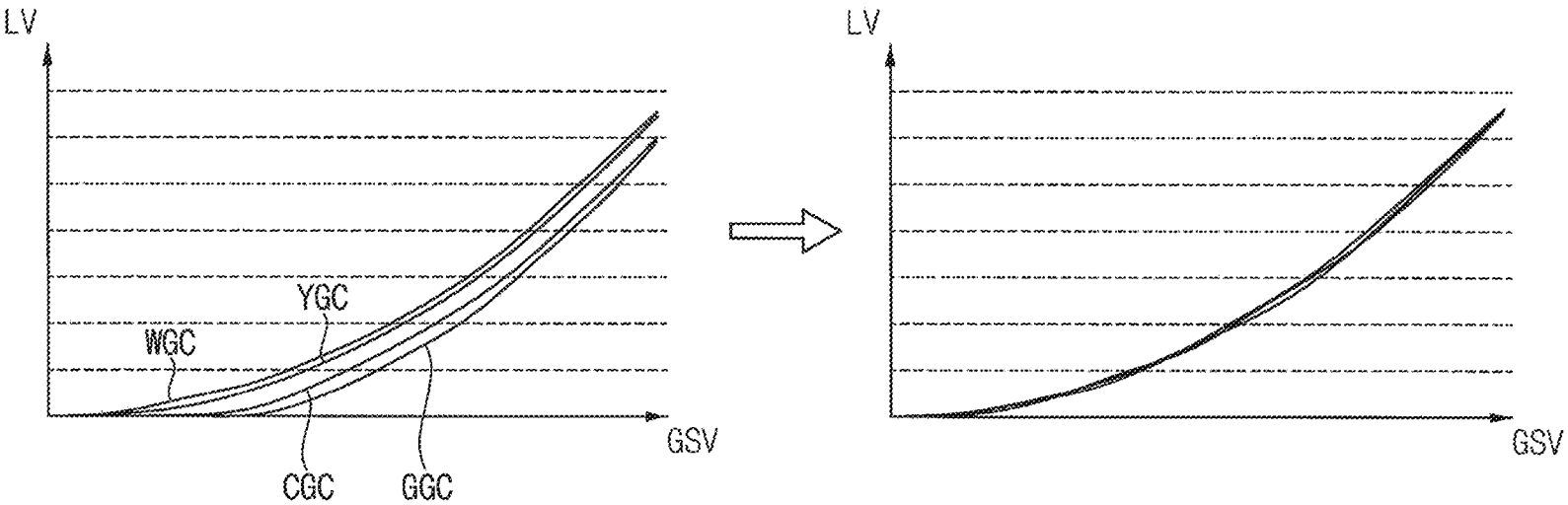

FIGS. 27 and 28 are diagrams illustrating luminance compensation of an electroluminescent display device according to some example embodiments.

Referring to FIG. 27, according to example embodiments, the luminance distortion due to lateral leakage may be reduced or prevented and the exact (or close) luminance may be realized. FIG. 27 illustrates results of measuring the luminance value LV of a green pixel with changing the grayscale value of red pixels. A first case CS1 is when example embodiments are not applied and a second case CS2 is when example embodiments are applied. As illustrated in FIG. 27, the luminance of the target pixel may be uniform while the input pixel values of the neighboring pixels are changed.

FIG. 28 illustrates results of measuring the gamma curves WGC, YGC, CGC and GGC when example embodiments are not applied. As illustrated in the right portion of FIG. 28, the single light gamma curves may approach the white light gamma cur WGC by applying the method of compensating for luminance in an electroluminescent display device according to some example embodiments.

Figure 29:
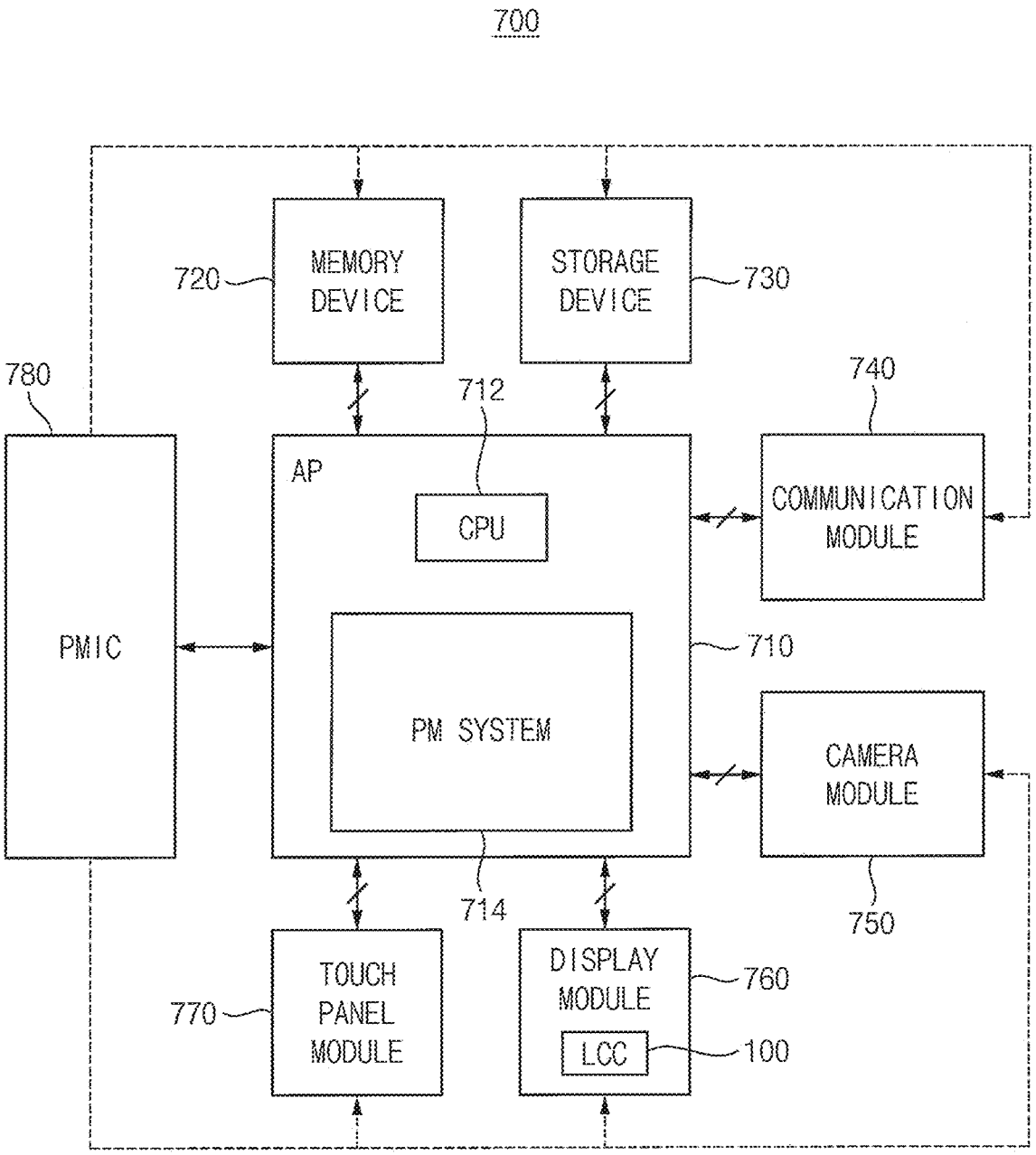
FIG. 29 is a block diagram illustrating a mobile device according to some example embodiments.

FIG. 29 is a block diagram illustrating a mobile device according to some example embodiments.

Referring to FIG. 29, a mobile device 700 includes a system on chip ("SoC") 710 and a plurality of functional modules 740, 750, 760 and 770. The mobile device 700 may further include a memory device 720, a storage device 730 and a power management device 780.

The SoC 710 controls overall operations of the mobile device 700. In some example embodiments, the SoC 710 controls the memory device 720, the storage device 730 and the plurality of functional modules 740, 750, 760 and 770, for example. The SoC 710 may be an application processor ("AP") that is included in the mobile device 700.

The SoC 710 may include a CPU 712 and a power management system PM SYSTEM 714. The memory device 720 and the storage device 730 may store data for operations of the mobile device 700. In some example embodiments, the memory device 720 may include a volatile memory device, such as at least one of dynamic random access memory ("DRAM"), a static random access memory ("SRAM"), a mobile DRAM, etc. In some example embodiments, the storage device 730 may include a nonvolatile memory device, such as at least one of an erasable programmable read-only memory ("EPROM"), an electrically EPROM ("EEPROM"), a flash memory, a phase change random access memory ("PRAM"), a resistance random access memory ("RRAM"), a nano floating gate memory ("NFGM"), a polymer random access memory ("PoRAM"), a magnetic random access memory ("MRAM"), a ferroelectric random access memory ("FRAM"), etc. In some example embodiments, the storage device 730 may further include at least one of a solid state drive ("SSD"), a hard disk drive ("HDD"), a CD-ROM, etc.

The functional modules 740, 750, 760 and 770 perform various functions of the mobile device 700. In some example embodiments, the mobile device 700 may include a communication module 740 that performs a communication function (e.g., at least one of a code division multiple access ("CDMA") module, a long term evolution ("LTE") module, a radio frequency (RF) module, an ultra-wideband ("UWB") module, a wireless local area network (WLAN) module, a worldwide interoperability for a microwave access ("WIMAX") module, etc.), a camera module 750 that performs a camera function, a display module 760 that performs a display function, a touch panel module 770 that performs a touch sensing function, etc., for example. In some example embodiments, the mobile device 700 may further include at least one of a global positioning system ("GPS") module, a microphone ("MIC") module, a speaker module, a gyroscope module, etc., for example. However, the functional modules 740, 750, 760, and 770 in the mobile device 700 are not limited thereto.

The power management device 780 may provide an operating voltage to the SoC 710, the memory device 720, the storage device 730 and the functional modules 740, 750, 760 and 770.

According to some example embodiments, the display module 760 includes a luminance compensation circuit LCC 100 as described above according to some example embodiments.

Figure 30:
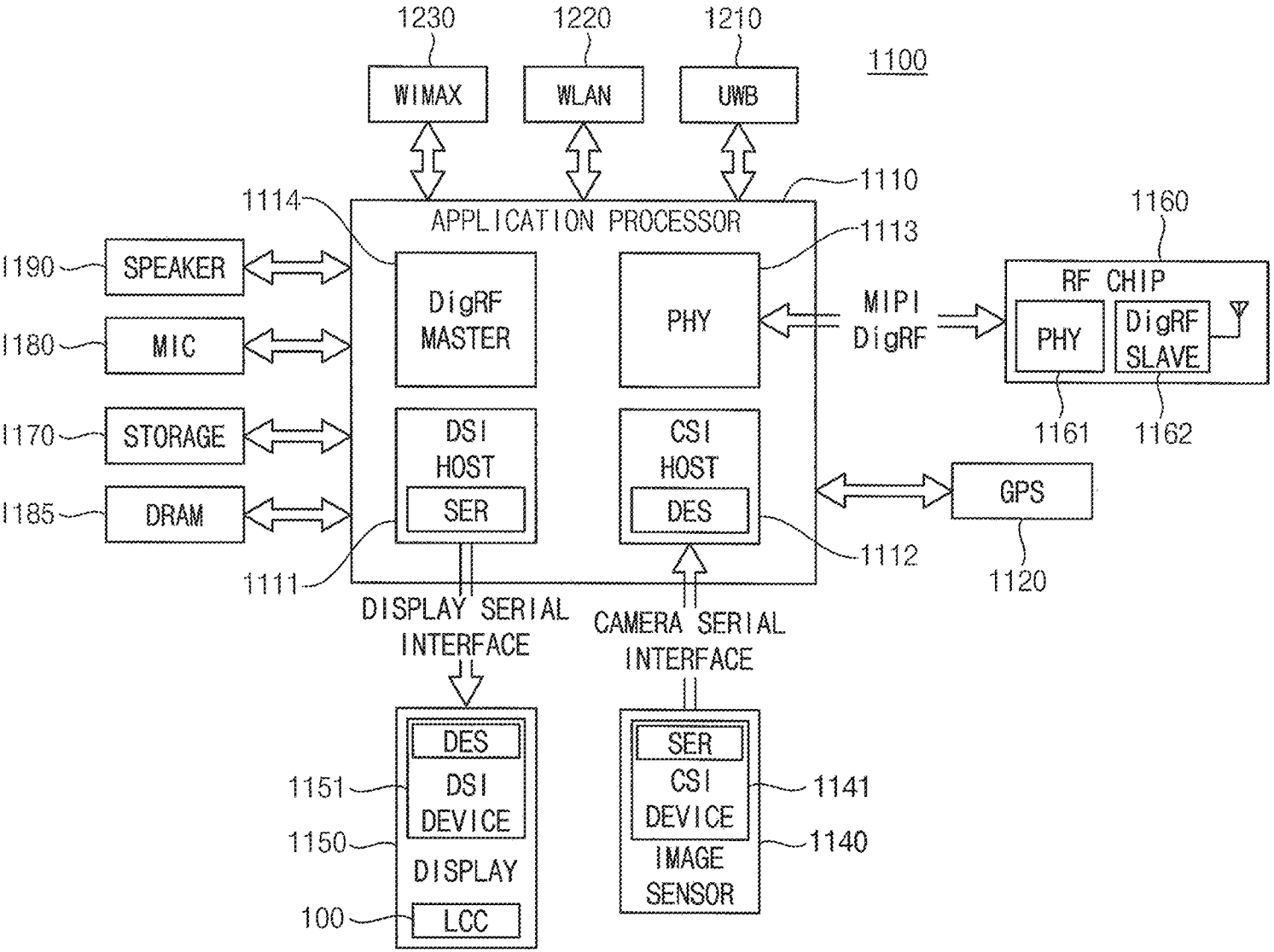
FIG. 30 is a block diagram illustrating a computing system according to some example embodiments.

FIG. 30 is a block diagram illustrating a computing system according to some example embodiments.

Referring to FIG. 30, a computing system 1100 may employ or support a MIPI interface, and may include an application processor 1110, a ToF sensor 1140 and a display device 1150. A CSI host 1112 of the application processor 1110 may perform a serial communication with a CSI device 1141 of the image sensor 1140 using a camera serial interface (CSI). In some example embodiments, the CSI host 1112 may include a deserializer DES, and the CSI device 1141 may include a serializer SER. A DSI host 1111 of the application processor 1110 may perform a serial communication with a DSI device 1151 of the display device 1150 using a display serial interface (DSI). In some example embodiments, the DSI host 1111 may include a serializer SER, and the DSI device 1151 may include a deserializer DES.

The computing system 1100 may further include a radio frequency (RF) chip 1160, which may include a physical layer PHY 1161 and a DigRF slave 1162. A physical layer PHY 1113 of the application processor 1110 may perform data transfer with the physical layer PHY 1161 of the RF chip 1160 using a MIPI DigRF. The PHY 1113 of the application processor 1110 may interface and/or communicate with a DigRF MASTER 1114 for controlling the data transfer with the PHY 1161 of the RF chip 1160.

The computing system 1100 may further include a global positioning system (GPS) 1120, a storage device 1170, a microphone 1180, a DRAM 1185 and/or a speaker 1190. The computing system 1100 may communicate with external devices using an ultra-wideband (UWB) communication interface 1210, a wireless local area network (WLAN) communication interface 1220, a worldwide interoperability for microwave access (WIMAX) communication interface 1230, or the like. However, example embodiments are not limited to configurations or interfaces of the computing system 1000 and 1100 illustrated in FIG. 22.

According to some example embodiments, the source driver of the display device 1150 includes a luminance compensation circuit LCC 100 as described above according to some example embodiments.

As described above, the electroluminescent display device and the method of compensating for luminance in the electronic device may realize the exact (or close) luminance of the input image by compensating for the luminance distortion due to the lateral leakage based on the leakage curve and the input pixel values.

In addition, the luminance of the input image may be realized exactly (or closely) regardless of the disposition and the emission distribution of the pixels by compensating for the luminance distortion pixel by pixel. Through the compensation of the lateral leakage, the quality of the displayed image may be improved, and the performance of the electroluminescent display device may be enhanced.

Any of the elements and/or functional blocks disclosed above may include or be implemented in processing circuitry such as hardware including logic circuits; a hardware/software combination such as a processor executing software; or a combination thereof. For example, processing circuitry, including the host processor 20 and timing controller 250, more specifically may include, but is not limited to, a central processing unit (CPU), an arithmetic logic unit (ALU), a digital signal processor, a microcomputer, a field programmable gate array (FPGA), a System-on-Chip (SoC), a programmable logic unit, a microprocessor, application-specific integrated circuit (ASIC), etc. The processing circuitry may include electrical components such as at least one of transistors, resistors, capacitors, etc. The processing circuitry may include electrical components such as logic gates including at least one of AND gates, OR gates, NAND gates, NOT gates, etc.

Processor(s), controller(s), and/or processing circuitry may be configured to perform actions or steps by being specifically programmed to perform those action or steps (such as with an FPGA or ASIC) or may be configured to perform actions or steps by executing instructions received from a memory, or a combination thereof.

Example embodiments may be applied to a display device and any electronic devices and systems. For example, the example embodiments may apply to systems such as a memory card, a solid state drive (SSD), an embedded multimedia card (eMMC), a universal flash storage (UFS), a mobile phone, a smart phone, a personal digital assistant (PDA), a portable multimedia player (PMP), a digital camera, a camcorder, a personal computer (PC), a server computer, a workstation, a laptop computer, a digital TV, a set-top box, a portable game console, a navigation system, a wearable device, an internet of things (IoT) device, an internet of everything (IoE) device, an e-book, a virtual reality (VR) device, an augmented reality (AR) device, a vehicle navigation system, a video phone, a monitoring system, an automatic focusing system, a tracking system, a motion sensing system, etc.

The foregoing is illustrative of example embodiments and is not to be construed as limiting thereof. Although a few example embodiments have been described, those skilled in the art will readily appreciate that many modifications are possible in the example embodiments without materially departing from the present inventive concepts.

What is claimed is:

1. An electroluminescent display device comprising:

a display panel including a plurality of pixels;

a storage circuit configured to store information on a leakage curve indicating a luminance change value of a target pixel according to a change of an input pixel value of a neighboring pixel, the plurality of pixels including the target pixel and the neighboring pixel;

a luminance compensation circuit configured to receive a plurality of input pixel values corresponding to the plurality of pixels, and generate a plurality of compensated pixel values respectively corresponding to the plurality of pixels by compensating for lateral leakage based on the leakage curve, the lateral leakage being caused by leakage currents through a common conduction layer of the plurality of pixels; and a data driver configured to drive the plurality of pixels based on the plurality of compensated pixel values, respectively.

2. The electroluminescent display device of claim 1, wherein the luminance compensation circuit is configured to:

set a compensation window including the target pixel and a plurality of neighboring pixels, the plurality of neighboring pixels including the neighboring pixel, the plurality of pixels including the plurality of neighboring pixels;

generate a leakage luminance change value based on respective input pixel values of the plurality of neighboring pixels and the leakage curve;

generate a target luminance change value based on an input pixel value of the target pixel and the leakage curve;

generate a compensation luminance change value corresponding to a difference between the leakage luminance change value and the target luminance change value; and generate a compensated pixel value of the target pixel based on the input pixel value of the target pixel and the compensation luminance change value.

3. The electroluminescent display device of claim 2, wherein the luminance compensation circuit is configured to generate the compensated pixel value of the target pixel corresponding to an input pixel value of the target pixel, and the compensation luminance change value based on a gamma curve corresponding to a target color of the target pixel.

4. The electroluminescent display device of claim 3, wherein the storage circuit stores a plurality of lookup tables, the plurality of lookup tables respectively corresponding to a plurality of color gamma curves, and each lookup table is a two-dimensional lookup table including a plurality of compensated grayscale values respectively corresponding to different combinations of a grayscale value and a compensation luminance change value.

5. The electroluminescent display device of claim 4, wherein the luminance compensation circuit is configured to:

compare an absolute value of a sum of the compensation luminance change values with a reference value; and correct the plurality of compensated pixel values in response to the absolute value being greater than the reference value.

6. The electroluminescent display device of claim 5, wherein the luminance compensation circuit is configured to correct the plurality of compensated pixel values by updating the leakage luminance change value based on the compensated pixel values respectively corresponding to the plurality of neighboring pixels without changing the target luminance change value that is based on the input pixel value of the target pixel.

7. The electroluminescent display device of claim 2, wherein the leakage curve includes a plurality of color leakage curves, the plurality of color leakage curves respectively corresponding to different combinations of a target color of the target pixel and a neighboring color of the neighboring pixel.

8. The electroluminescent display device of claim 7, wherein the luminance compensation circuit is configured to:

generate a per-pixel target luminance change value corresponding to the target pixel and a per-pixel leakage luminance change value corresponding to each neighboring pixel based on each color leakage curve corresponding to the target color of the target pixel and the neighboring color of each neighboring pixel;

generate the leakage luminance change value by summing a plurality of per-pixel leakage luminance change values respectively corresponding to the plurality of neighboring pixels; and generate the target luminance change value by summing a plurality of per-pixel target luminance change values respectively corresponding to the target pixel and the plurality of neighboring pixels.

9. The electroluminescent display device of claim 8, wherein the luminance compensation circuit is configured to generate the per-pixel leakage luminance change value or the per-pixel target luminance change value corresponding to the target pixel by performing interpolation based on at least one of grayscale values adjacent to an input pixel value of each neighboring pixel and an input pixel value of the target pixel among the plurality of scale values included in each lookup table.

10. The electroluminescent display device of claim 7, wherein the storage circuit stores a plurality of lookup tables, the plurality of lookup tables respectively corresponding to the plurality of color leakage curves, and each lookup table among the plurality of lookup tables includes a plurality of grayscale values and a plurality of luminance change values respectively corresponding to the plurality of grayscale values.

11. The electroluminescent display device of claim 2, wherein the luminance compensation circuit is configured to:

generate the compensated pixel value of the target pixel by increasing the input pixel value of the target pixel in response to the leakage luminance change value being smaller than the target luminance change value; and generate the compensated pixel value of the target pixel by decreasing the input pixel value of the target pixel in response to the leakage luminance change value being greater than the target luminance change value.

12. The electroluminescent display device of claim 1, wherein the leakage curve includes a plurality of color leakage curves, each of the plurality of color leakage curves respectively corresponding to different combinations of a target color of the target pixel and a neighboring color of the neighboring pixel.

13. The electroluminescent display device of claim 12, wherein each color leakage curve of the plurality of color leakage curves includes two or more target color leakage curves, each of the two or more target color leakage curves respectively corresponding to two or more grayscale values of the target pixel, and wherein the luminance compensation circuit is configured to compensate for the lateral leakage by performing interpolation based on the two or more target color leakage curves.

14. The electroluminescent display device of claim 12, wherein each color leakage curve of the plurality of color leakage curves includes two or more reference color leakage curves, each of the two or more reference color leakage curves respectively corresponding to two or more grayscale values of a reference neighboring pixel, the reference neighboring pixel corresponding to a reference color that is different from the target color and the neighboring color, and wherein the luminance compensation circuit is configured to compensate for the lateral leakage by performing interpolation based on the two or more reference color leakage curves.

15. The electroluminescent display device of claim 1, wherein the luminance compensation circuit is configured to output an input pixel value of the target pixel as a compensated pixel value of the target pixel in response to the input pixel value of the target pixel being greater than a reference grayscale value.

16. The electroluminescent display device of claim 15, wherein the luminance compensation circuit is configured such that the reference grayscale value decreases as a target luminance of the electroluminescent display device increases.

17. A method of compensating for luminance in an electroluminescent display device, comprising:

generating information on a leakage curve indicating a luminance change value of a target pixel according to a change of an input pixel value of a neighboring pixel;

receiving a plurality of input pixel values corresponding to a plurality of pixels included in a display panel, the plurality of pixels including the target pixel and the neighboring pixel;

generating a plurality of compensated pixel values respectively corresponding to the plurality of pixels by compensating for lateral leakage based on the leakage curve, the lateral leakage being caused by leakage currents through a common conduction layer of the plurality of pixels; and driving the plurality of pixels based on the plurality of compensated pixel values.

18. The method of claim 17, wherein the leakage curve includes a plurality of color leakage curves, the plurality of color leakage curves respectively corresponding to different combinations of a target color of the target pixel and a neighboring color of the neighboring pixel, respectively.

19. A method of compensating for luminance in an electroluminescent display device, comprising:

setting a compensation window, the compensation window including a target pixel and a plurality of neighboring pixels;

generating a leakage luminance change value based on input pixel values of the plurality of neighboring pixels and a leakage curve indicating a luminance change value of the target pixel according to a change of an input pixel value of a neighboring pixel;

generating a target luminance change value based on an input pixel value of the target pixel and the leakage curve;

generating a compensation luminance change value, the compensation luminance change value corresponding to a difference between the leakage luminance change value and the target luminance change value;

generating a compensated pixel value of the target pixel based on the input pixel value of the target pixel and the compensation luminance change value; and driving the target pixel based on the compensated pixel value of the target pixel.

20. The method of claim 19, wherein the compensated pixel value of the target pixel is generated by increasing the input pixel value of the target pixel in response to the leakage luminance change value being smaller than the target luminance change value; and the compensated pixel value of the target pixel is generated by decreasing the input pixel value of the target pixel in response to the leakage luminance change value being greater than the target luminance change value.

* * * * *